US005242791A

United States Patent [19]

Hirano et al.

[11] Patent Number: 5,242,791

[45] Date of Patent: Sep. 7, 1993

[54] SILVER HALIDE PHOTOGRAPHIC LIGHT-SENSITIVE MATERIAL

[75] Inventors: Katsumi Hirano; Mikio Ihama; Hiroyuki Mifune, all of Minami-Ashigara, Japan

[73] Assignee: Fuji Photo Film Co., Ltd., Kanagawa, Japan

[21] Appl. No.: 692,356

[22] Filed: Apr. 26, 1991

[30] Foreign Application Priority Data

Apr. 27, 1990 [JP] Japan ..... 2-110558
Dec. 27, 1990 [JP] Japan ..... 2-407125

[51] Int. Cl.[5] ..... G03C 1/09; G03C 1/34

[52] U.S. Cl. ..... 430/603; 430/569; 430/600; 430/607; 430/611; 430/613

[58] Field of Search ..... 430/603, 600, 607, 611, 430/613, 569

[56] References Cited

U.S. PATENT DOCUMENTS

| | | | |
|---|---|---|---|
| 4,565,778 | 1/1986 | Miyamoto et al. | 430/569 |
| 4,849,324 | 7/1989 | Aida et al. | 430/611 |
| 4,923,793 | 5/1990 | Shibahara | 430/611 |
| 5,112,733 | 5/1912 | Ihama | 430/569 |

FOREIGN PATENT DOCUMENTS

| | | |
|---|---|---|
| 0122125 | 10/1984 | European Pat. Off. . |
| 0302251 | 5/1992 | European Pat. Off. . |

OTHER PUBLICATIONS

Patent Abstracts of Japan vol. 9, No. 327 (P-415) (2050), Dec. 21, 1985.

Patent Abstracts of Japan vol. 14, No. 223 (P-1046 (4166), May 11, 1990.

*Primary Examiner*—Charles L. Bowers, Jr.
*Assistant Examiner*—Thorl Chea
*Attorney, Agent, or Firm*—Birch, Stewart, Kolasch & Birch

[57] ABSTRACT

In a silver halide photographic light-sensitive material having at least one silver halide emulsion layer on a support, light-sensitive silver halide grains contained in the silver halide emulsion layer have been subjected to selenium sensitization, and the silver halide emulsion layer or another hydrophilic colloid layer which is in a water-permeable relationship with the silver halide emulsion layer contains at least one compound represented by formula (I) (wherein Z represents a heterocyclic ring directly or indirectly having at least one substituent group selected from the group consisting of $-SO_3M$, $-COOR_1$, $-OH$, and $-NHR_2$, M represents hydrogen, alkali metal, quaternary ammonium, or quaternary phosphonium, $R_1$ represents hydrogen, alkali metal, or alkyl having 1 to 6 carbon atoms, $R_2$ represents hydrogen, alkyl having 1 to 6 carbon atoms, $-COR_3$, $-COOR_3$, or $-SO_2R_3$, and $R_3$ represents hydrogen, aliphatic, or aromatic):

Formula (I)

17 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and a method for developing the same, and, more particularly, to a silver halide photographic light-sensitive material and a method for developing the same, using a silver halide emulsion having an improved sensitivity/fog ratio and improved storage stability.

2. Description of the Related Art

A silver halide emulsion for use in a silver halide photographic light-sensitive material is generally subjected to chemical sensitization using various types of chemical substances to obtain desired sensitivity, gradation, and the like. Typical examples of the chemical sensitization are sulfur sensitization, selenium sensitization, and noble metal sensitization such as gold sensitization, reduction sensitization, and various combinations thereof.

Recently, strong demands have arisen for high sensitivity, high graininess, and high sharpness in a silver halide photographic light-sensitive material and rapid processing in which, for example, a development speed is increased. For this reason, various improvement in above the sensitization have been done.

Of the above sensitization methods, the selenium sensitization methods are disclosed in, for example, U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491 ("JP-B-" means Published Examined Japanese Patent Application), JP-B-52-34492, JP-B-53-295, JP-B-57-22090, JP-A-59-180536 ("JP-A-" means Published Unexamined Japanese Patent Application), JP-A-59-185330, JP-A-59-181337, JP-A-59-187338, JP-A-59-192241, JP-A-60-150046, JP-A-60-151637, JP-A-61-246738, British Patents 255,846 and 861,984, and H. E. Spencer et al., "Journal of Photographic Science", Vol. 31, PP. 158 to 169 (1983). In general, the selenium sensitization has a superior sensitizing effect to that of the sulfur sensitization normally executed by those skilled in the art but produces a large amount of fog and tends to cause a low gradation. Although many of the above-mentioned well-known patents have been made to solve the above problems, only unsatisfactory results have been obtained. Therefore, a strong demand has arisen for, in particular, a basic improvement of suppressing fog.

In addition, especially when the gold sensitization is performed together with the sulfur sensitization or the selenium sensitization, fog is increased though a significant increase is obtained in sensitivity at the same time. An increase in fog is particularly large in gold-selenium sensitization compared to gold-sulfur sensitization. For this reason, development of techniques of suppressing fog has been strongly desired.

SUMMARY OF THE INVENTION

It is an object of the present invention to provide a silver halide photographic light-sensitive material and a method for developing the same, which produces low fog and has high sensitivity and high storage stability.

The above object of the present invention is achieved by the following means. According to the present invention, the sensitizing effect of selenium sensitization can be satisfactorily realized, which is difficult to achieve by the conventional techniques. More specifically, the above object of the present invention is achieved by the following:

(1) A silver halide photographic light-sensitive material having at least one silver halide emulsion layer on a support, wherein light-sensitive silver halide grains contained in the silver halide emulsion layer have been subjected to selenium sensitization, and the silver halide emulsion layer o another hydrophilic colloid layer which is in a water-permeable relationship with the silver halide emulsion layer contains at least one compound represented by formula (I) described in Table A to be presented later (in formula (I), Z represents a heterocyclic ring directly or indirectly having at least one group selected from the group consisting of $-SO_3M$, $-COOR_1$, $-OH$, and $-NHR_2$, M represents hydrogen, alkali metal, quaternary ammonium, or quaternary phosphonium, $R_1$ represents hydrogen, alkali metal, or alkyl having 1 to 6 carbon atoms, $R_2$ represents hydrogen, alkyl having 1 to 6 carbon atoms, $-COR_3$, $-COOR_3$, or $-SO_2R_3$, and $R_3$ represents hydrogen, aliphatic, or aromatic), (2) A silver halide photographic light-sensitive material having at least one silver halide emulsion layer on a support, wherein light-sensitive silver halide grains contained in the silver halide emulsion layer have been subjected to selenium sensitization, and the silver halide emulsion layer or another hydrophilic colloid layer which is in a water-permeable relationship with the silver halide emulsion layer contains at least one compound represented by formula (II) described in Table A to be presented later (in formula (II), Y and W independently represent nitrogen or $CR_4$ (wherein $R_4$ represents hydrogen, substituted or nonsubstituted alkyl, or substituted or nonsubstituted aryl), $R_5$ represents an organic moiety having at least one substituent group selected from the group consisting of $-SO_3M$, $-COOM$, $-OH$, and $-NHR_2$, M represents hydrogen, alkali metal, quaternary ammonium, or quaternary phosphonium, $R_2$ represents hydrogen, an alkyl group having 1 to 6 carbon atoms, $-COR_3$, $-COOR_3$, or $-SO_2R_3$, $L_1$ represents a bonding group selected from the group consisting of —S—, —O—, —N(—)—, —CO—, —SO—, and $-SO_2-$, and n represents 0 or 1), (3) A silver halide photographic light-sensitive material having at least one silver halide emulsion layer on a support, wherein light-sensitive silver halide grains contained in the silver halide emulsion layer have been subjected to selenium sensitization, and the silver halide emulsion layer or another hydrophilic colloid layer which is in a water-permeable relationship with the silver halide emulsion layer contains at least one compound represented by formula (III) described in Table A to be presented later (in formula (III), X represents sulfur, oxygen, or $-NR_6-$, $R_6$ represents hydrogen, substituted or nonsubstituted alkyl, or substituted or nonsubstituted aryl, $L_2$ represents $-CONR_7$, $-NR_7CO-$, $-SO_2NR_7-$, $-NR_7SO_2-$, —OCO—, —COO—, —S—, $-NR_7-$, —CO—, —SO—, $-OCOO-$, $-NR_7CONR_8-$, $-NR_7COO-$, $-OCONR_7-$, or $-NR_7SO_2NR_8-$, $R_7$ and $R_8$ independently represent hydrogen, substituted or nonsubstituted alkyl, or substituted or nonsubstituted aryl, and $R_5$ represents an organic moiety having at least one substituting group selected from the group consisting of —$SO_3M$, —COOM, —OH, and —$NHR_2$), (4) A silver halide photographic light-sensitive material having at least one silver halide emulsion layer on a support, wherein light-sensitive silver halide grains contained in the silver halide emulsion layer have been subjected to selenium sensitization, and the silver halide emulsion layer or another hydrophilic colloid layer which is in a water-permeable relationship with the silver halide emulsion layer contains at least one compound represented by formula (II) described in item (2) above and at least one compound represented by formula (III) described in item (3) above, (5) A method for processing a silver halide color photographic light-sensitive material wherein the silver halide photographic light-sensitive material described in item (1) is color-developed at a temperature of 40° C. or more, and (6) A method for processing a silver halide color photographic light-sensitive material wherein the volume of the replenisher when the silver halide photographic light-sensitive material described in item (1) is color-developed is 1,000 ml or less per 1 $m^2$ of the light-sensitive material.

DETAILED DESCRIPTION OF THE INVENTION

The present invention will be described in detail below.

A compound represented by formula (I) of the present invention is known as an antifoggant. For example, JP-A-64-0531 discloses the compound as an antifoggant and a storage stability improving agent for a shallow internal latent image emulsion, and JP-A-02-000837 discloses the example as an antifoggant and a low-intensity failure improving agent for tabular grains.

However, no practical example of applying a compound of formula (I) to a selenium-sensitized silver halide emulsion has yet been reported. Although it was very difficult to predict antifoggant effects and other photographic effects obtained by these compounds, significant effects could be obtained by using the compounds together with selenium sensitization.

As a selenium sensitizer to be used in the present invention, the selenium compounds disclosed in the patents described in "Description of the Related Art" can be used. In particular, a labile selenium compound capable of reacting with silver nitrate in an aqueous solution to form precipitation of silver selenide can be used. Examples of this selenium compound are described in U.S. Pat. Nos. 1,574,944, 1,602,592, 1,623,499, and 3,297,446. More specifically, examples of the selenium compound are as follows:

colloidal metal selenium, isoselenocyanates (for example, arylisoselenocyanate), selenoureas (for example, selenourea; aliphatic selenourea such as N,N-dimethylselenourea and N,N-diethylselenourea; substituted selenourea having an aromatic group such as a phenyl group or a heterocyclic group such as a pyridyl group), selenoketones (for example, selenoacetone and selenoacetophenone), selenoamides (for example, selenoacetoamide), selenocarboxylic acid and esters (for example, 2-selenopropionic acid and methyl-3-selenobutyrate), selenides (for example, diethylselenide and triphenylphosphineselenide), and selenophosphates (for example, tri-p-tolylselenophosphate).

Although an amount of the selenium sensitizer changes in accordance with the types of selenium compound and silver halide grains and the chemical ripening conditions, it is generally $10^{-8}$ to $10^{-4}$ mol, and preferably, $10^{-7}$ to $10^{-5}$ mol per mol of a silver halide. The selenium sensitizer is preferably added subsequent to desalting performed after grain formation.

In addition, although the chemical sensitization conditions of using the selenium sensitizer are not particularly limited, a pAg is 6 to 11, preferably, 7 to 10, and more preferably, 7 to 9.5, and a temperature is 40° C. to 95° C., and preferably, 50° C. to 85° C.

In the present invention, a noble metal sensitizer such as gold, platinum, palladium, and iridium is preferably used together with the selenium sensitizer. Particularly, it is preferable to use the gold sensitizer together with the selenium sensitizer. Examples of the noble metal sensitizer are chloroauric acid, potassium chloroaurate, potassium aurithiocyanate, gold sulfide, and gold selenide. The noble metal sensitizer can be used in an amount of about $10^{-7}$ to $10^{-2}$ mol per mol of a silver halide.

In the present invention, the use of a sulfur sensitizer is also preferred. Examples of the sulfur sensitizer are known labile sulfur compounds such as thiosulfates (for example, hypo), thioureas (for example, diphenylthiourea, triethylthiourea, and arylthiourea), and rhodanines. The sulfur sensitizer can be used in an amount of about $10^{-7}$ to $10^{-2}$ mol per mol of a silver halide.

In the present invention, a reduction sensitizer can also be used. Examples of the reduction sensitizer are stannous chloride, aminoiminomethanesulfinic acid, hydrazine derivatives, borane compounds, silane compounds, and polyamine compounds.

In the present invention, the selenium sensitization is preferably performed in the presence of a silver halide solvent.

Examples of the silver halide solvent are thiocyanate (for example, potassium thiocyanate), thioether compounds (for example, compounds described in U.S. Pat. Nos. 3,021,215 and 3,271,157, JP-B-58-30571, and JP-A-60-136736, in particular, 3,6-dithia-1, 8-octanediol), tetra-substituted thiourea compound (for example, compounds described in JP-B-59-11892 and U.S. Pat. No. 4,221,863, in particular, tetramethylthiourea), thione compounds described in JP-B-60-11341, mercapto compounds described in JP-B-63-29727, meso-ion compounds described in JP-A-60-163042, selenoether compounds described in U.S. Pat. No. 4,782,013, telluroether compounds described in JP-A-2-118566, and sulfites. Of these compounds, thiocyanates, a thioether compounds, tetra-substituted thiourea compounds, and thione compounds can be particularly preferably used. The silver halide solvent can be used in an amount of about $10^{-5}$ to $10^{-2}$ mol per mol of a silver halide.

As described above, a compound represented by formula (I) is contained in an emulsion layer containing a silver halide emulsion subjected to selenium sensitization or another hydrophilic colloid layer which is in a water-permeable relationship with the emulsion layer. The water-permeable relationship means a relationship in that water can freely permeate between the two layers in a alkaline atmosphere upon development. This hydrophilic colloid layer includes another emulsion layer in direct or indirect contact with the emulsion layer, an interlayer, a color-mixing preventing layer, an antihalation layer, a filter layer, and a protective layer but does not include a back layer formed on the opposite side of a support.

The hydrophilic colloid layer typically contains gelatin, denaturated gelatin, a hydrophilic vinyl polymer such as polyvinylalcohol, or a mixture thereof.

A compound of the present invention represented by formula (I) will be described below.

In formula (I), Z represents a heterocyclic moiety directly or indirectly bonding at least one substituent group selected from the group consisting of $—SO_3M$, $—COOR_1$, —OH—, and $—NHR_4$. Example of the heterocyclic ring are oxazole ring, thiazole ring, imidazole ring, selenazole ring, triazole ring, tetrazole ring, thiadiazole ring, oxadiazole ring, pentazole ring, pyrimidine ring, thiazine ring, triazine ring, and thiodiazine ring, and ring bonding another carbon ring or a heterocyclic ring, for example, benzothiazole ring, benzotriazole ring, benzimidazole ring, benzoxazole ring, benzoselenazole ring, naphthoxazole ring, triazaindolizine ring, diazaindolizine ring, and tetrazaindolizine ring.

Preferable examples of the ring are imidazole ring, tetrazole ring, benzimidazole ring, benzothiazole ring, benzoxazole ring, and triazole ring.

In formula (I), M represents hydrogen, alkaline metal, quaternary ammonium, or quaternary phosphonium, $R_1$ represents hydrogen, alkali metal, or alkyl having 1 to 6 carbon atoms, $R_2$ represents hydrogen, alkyl having 1 to 6 carbon atoms, $—COR_3$, $—COOR_3$, or $—SO_2R_3$, and $R_3$ represents hydrogen, an aliphatic group, or an aromatic group. These groups may further have substituting groups.

Preferable examples of a mercapto heterocyclic compound represented by formula (I) are compounds represented by formulas (II) and (III).

In formula (II), Y and W independently represent nitrogen atom or $CR_4$ (wherein $R_4$ represents hydrogen, substituted or nonsubstituted alkyl, or substituted or nonsubstituted aryl), $R_5$ represents an organic moiety having at least one substituent group selected from the group consisting of $—SO_3M$, —COOM, —OH, and $—NHR_2$, and more specifically, alkyl having 1 to 20 carbon atoms (for example, methyl, ethyl, propyl, hexyl, dodecyl, or octadecyl) or aryl having 6 to 20 carbon atoms (for example, phenyl or naphthyl), $L_1$ represents a bonding group selected from the group consisting of —S—, —O—, —N(—)—, —CO—, —SO—, and $—SO_2—$, and n represents 0 or 1.

These alkyl and aryl groups may have further another substituting group such as a halogen atom (for example, F, Cl, or Br), alkoxy (for example, methoxy or methoxyethoxy), aryloxy (for example, phenoxy), alkyl (when $R_2$ represents aryl), aryl (when $R_2$ represents alkyl), amido (for example, acetoamido or benzoylamino), carbamoyl (for example, nonsubstituted carbamoyl, phenylcarbamoyl, or methylcarbamoyl), sulfonamido (for example, methanesulfonamido and phenylsulfonamido), sulfamoyl (for example, nonsubstituted sulfamoyl, methylsulfamoyl, or phenylsulfamoyl), sulfonyl (for example, methylsulfonyl or phenylsulfonyl), sulfinyl (for example, methylsulfinyl or phenylsulfinyl), cyano, alkoxycarbonyl (for example, methoxycarbonyl), aryloxycarbonyl (for example, phenoxycarbonyl), or nitro.

If two or more substituting groups of $R_5$, that is, $—SO_3M$, —COOM, —OH, and $—NHR_2$ are present, they may be the same or different.

$R_2$ and M have the same meanings as those described in formula (I).

In formula (III), X represents sulfur, oxygen, or $—NR_6—$, $R_6$ represents hydrogen, substituted or nonsubstituted alkyl, or substituted or nonsubstituted aryl.

In the present invention, X is preferably a sulfur atom.

$L_2$ represents $—CONR_7—$, $—NR_7CO—$, $—SO_2NR_7—$, $—NR_7SO_2—$, —OCO—, —COO—, —S—, $—NR_7—$, —CO—, —SO—, —OCOO— $—NR_7CONR_8—$, $—NR_7COO—$, $—OCONR_7—$, or $—NR_7SO_2NR_8—$, and $R_7$ and $R_8$ independently represent hydrogen, substituted or nonsubstituted alkyl, or substituted or nonsubstituted aryl.

$R_5$ and M have the same meanings as described in formulas (I) and (II), and n represents 0 or 1.

Examples of substituting groups of the alkyl and the aryl represented by $R_4$, $R_6$, $R_7$, and $R_8$ are those enumerated above as the substituting groups of $R_5$.

In the formulas, $R_5$ is preferably $—SO_3M$ and —COOM.

In the present invention, the use of a compound represented by formula (II) together with that represented by formula (III) is most preferred.

Preferable examples of compounds represented by formulas (I), (II), and (III) are listed in Table B to be presented later.

Compounds represented by formulas (I), (II), and (III) are known to those skilled in the art and can be synthesized by methods described in the following references.

U.S. Pat. Nos. 2,585,388 and 2,541,924; JP-B-42-21842; JP-A-53-50169; British Patent 1,275,701; D. A. Berges et al., "Journal of Heterocyclic Chemistry", Vol. 15, No. 981 (1978), "The Chemistry of Heterocyclic Chemistry", Imidazole and Derivatives, Part I, pp. 336 to 339; Chemical Abstract, 58, No. 7921 (1963), page 394; E. Hoggarth, "Journal of Chemical Society", pp. 1,160 to 1,167 (1949); S. R. Saudler, W. Karo, "Organic Functional Group Preparation", Academic Press, pp. 312 to 315, (1968); M. Chamdon, et al., Bulletin de la Societe Chimique de France, 723 (1954); D. A. Shirley, D. W. Alley, J. Amer. Chem. Soc., 79, 4,922 (1954); A. Wohl, W. Marchwald, Ber., German Chemical Magazine, Vol. 22, page 568 (1889); J. Amer. Chem. Soc., 44, pp. 1,502 to 1,510; U.S. Pat. No. 3,017,270; British Patent 940,169; JP-B-49-8334; JP-A-55-59463; Advanced in Heterocyclic Chemistry; West German Patent No. 2,716,707; The Chemistry of Heterocyclic Compounds Imidazole and Derivatives, Vol. 1, page 385; Org. Synth., IV., page 569 (1963), Ber. 9, 465 (1976); J. Amer. Chem. Soc., 45, 2,390 (1923); JP-A-50-89034, JP-A-53-28426, and JP-A-55-21007; and JP-B-40-28496.

The compound represented by formula (I), (II), or (III) is contained in a silver halide emulsion layer or a hydrophilic colloid layer (for example, an interlayer, a surface protective layer, a yellow filter layer, or an antihalation layer).

The compound is preferably contained in the silver halide emulsion layer or its adjacent layer.

An addition amount of the compound is preferably $1\times10^{-5}$ to $1\times10^{-1}$ g/m$^2$, more preferably, $5\times10^{-5}$ to $1\times10^{-2}$ g/m$^2$, and most preferably, $1\times10^{-4}$ to $5\times10^{-3}$ g/m$^2$.

The compound can be added to the emulsion in accordance with conventional methods of adding photographic emulsion additives. For example, the compound can be dissolved in methylalcohol, ethylalcohol, methylcellosolve, acetone, water, or a solvent mixture thereof and added in the form of a solution.

The compound represented by formula (I), (II), or (III) can be added during any one of photographic emulsion manufacturing steps and can be added at any time during the period between the end of the manufacture of an emulsion and start of coating. In the present invention, the compound can be effectively added after completion of silver halide grain formation and before chemical ripening.

The compound represented by formula (I), (II), or (III) is used in an amount of $1\times10^{-6}$ to $1\times10^{-1}$ mol, and preferably, $1\times10^{-5}$ to $8\times10^{-3}$ mol per mol of silver halide subjected to selenium sensitization.

In the present invention, the use of a compound represented by formula (II) together with a compound represented by formula (III) is most preferred. In this case, the addition times of compounds represented by formulas (II) and (III) may be the same or different. For example, a compound represented by formula (II) may be added in the period between after completion of silver halide grain formation and immediately before chemical ripening while a compound represented by formula (III) is added in the period after completion of the chemical ripening and immediately before coating, or vice versa. Alternatively, compounds represented by formulas (II) and (III) may be divisionally added in the period between after completion of silver halide grain formation and before chemical ripening and the period between after completion of the chemical ripening and immediately before coating. When compounds represented by formulas (II) and (III) are used together, an addition amount of each compound is $1\times10^{-6}$ to $1\times10^{-1}$ mol, and preferably, $1\times10^{-5}$ to $8\times10^{-3}$ mol per mol of a silver halide subjected to selenium sensitization. An addition amount ratio between the two compounds is preferably 1:100 to 100:1, and most preferably, 1:20 to 20:1.

Preferable examples of a silver halide emulsion to be subjected to selenium sensitization according to the present invention are silver bromide, silver iodobromide, silver iodochlorobromide, silver chlorobromide, and silver chloride. Most preferable examples are silver iodobromide and silver iodochlorobromide, containing 1 mol % or more and 15 mol % or less of silver iodide.

A silver halide grain to be subjected to selenium sensitization according to the present invention may have a regular crystal shape such as a cube or an octahedron, an irregular crystal shape such as a sphere or a plate, or a composite shape thereof. Although a mixture of grains having various crystal shapes can be used, the use of a regular crystal shape is preferred.

In a silver halide grain to be subjected to selenium sensitization according to the present invention, phases in the interior and the surface layer may be different or uniform. The silver halide grain may be a grain on the surface of which a latent image is mainly formed (for example, a negative type emulsion) or a grain in the interior of which a latent image is mainly formed (for example, an internal latent image emulsion or a fogged direct reversal emulsion). The silver halide grain is preferably the grain on the surface of which a latent image is mainly formed.

A silver halide emulsion used in the present invention is preferably a tabular grain emulsion in which 50% or more of a total projected area are occupied by grains having a thickness of 0.5 microns or less, and preferably, 0.3 microns or less, a diameter of 0.6 microns or more, and an average aspect ratio of 3 or more, or a monodisperse emulsion in which a statistical variation coefficient (a value of S/d obtained by dividing a standard deviation (S) by an average diameter (d) of the circle-equvalent diameter of the projected area) is 20% or less. Alternatively, two or more types of tabular grain emulsions and monodisperse emulsions may be mixed.

The photographic emulsion used in the present invention can be prepared by methods described in, for example, P. Glafkides, "Chimie et Physique Photographique", Paul Montel, 1967; G. F. Duffin, "Photographic Emulsion Chemistry", Focal Press, 1966; and V. L. Zelikman et al., "Making an Coating Photographic Emulsion", Focal Press, 1964.

To control growth of grains during formation of silver halide grains, ammonia, potassium thiocyanate, ammonium thiocyanate, a thioether compound (for example, U.S. Pat. Nos. 3,271,157, 3,574,628, 3,704,130, 4,297,439, and 4,276,374), a thione compound (for example, JP-A-53-144319, JP-A-53-82408, and JP-A-55-77737), and an amine compound (for example, JP-A-54-100717) can be used as silver halide solvent.

During formation or physical ripening of silver halide grains, cadmium salt, zinc salt, thallium salt, iridium salt or its complex salt, rhodium salt or its complex salt, and iron salt or iron complex salt may be used.

When silver iodobromide or silver iodochlorobromide is used as an emulsion of a light-sensitive material of the present invention, a relative standard deviation of a silver iodide content of individual silver halide grains in the emulsion is preferably 20% or less. If the relative standard deviation exceeds 20%, an increase in fog and degradation in gradation undesirably occur.

The measurement of silver iodide contents of individual grains can be performed by methods described in JP-A-2-256043.

A silver halide photographic emulsion which can be used together in the light-sensitive material of the present invention can be prepared by methods described in, for example, Research Disclosure (RD) No. 17643 (December, 1978), pp. 22 and 23, "I. Emulsion preparation and types" and RD No. 18716 (November, 1979), page 648; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

A crystal structure may be uniform, may have different halogen compositions in the interior and surface layer thereof, or may be a layered structure. Alternatively, a silver halide having a different composition may be bonded by an epitaxial junction or a compound except for a silver halide such as silver rhodanide or zinc oxide may be bonded.

A mixture of grains having various types of crystal shapes may be used.

A silver halide emulsion layer is normally subjected to physical ripening, chemical ripening, and spectral sensitization steps before it is used.

Additives for use in these steps are described in Research Disclosure Nos. 17643 and 18716, and they are summarized in the following table.

Known photographic additives usable in the present invention are also described in the above two RDs, and they are similarly summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left colunn |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

The color developer used in the present invention contains a known aromatic primary amine color developing agent. Preferable examples are p-phenylene diamine derivatives, and typical examples are shown as follows, but the invention shall not be limited by any of these examples.

| | |
|---|---|
| D-1 | N,N-diethyl-p-phenylene diamine |
| D-2 | 2-amino-5-diethylamine toluene |
| D-3 | 2-amio-5-(N-ethyl-N-laurylamino) toluene |
| D-4 | 4-[N-ethyl-N-(β-hydroxyethyl)amino] aniline |
| D-5 | 2-methyl-4[N-ethyl-N-(β-hydroxyethyl)amino] aniline |
| D-6 | 4-amino-3-methyl-N-ethyl-N[β-(methanesulfonamido) ethyl] aniline |
| D-7 | N-(2-amino-5-diethylaminophenylethyl) methane sulfonamide |
| D-8 | N,N-diethyl-p-phenylenediamine |
| D-9 | 4-amino-3-methyl-N-ethyl-N-methoxyethyl aniline |
| D-10 | 4-amino-3-methyl-N-ethyl-N-β-ethoxyethyl aniline |
| D-11 | 4-amino-3-methyl-N-ethyl-N-β-butoxyethyl aniline |

Of the above p-phenylenediamine derivatives, the particularly preferable compound is exemplified compound D-5.

These p-phenylenediamine derivatives may be salts such as sulfate, hydrochloride, sulfite, and p-toluene sulfonate.

The above color developing agents are used at a rate of 0.013 mol to 0.065 mol per 1 L of color developer, but, for rapid development, 0.016 mol to 0.048 mol are preferable, and, in particular, 0.019 mol to 0.032 mol are the most preferable.

To the color developer, sulfite such as sodium sulfite, potassium sulfite, sodium bisulfite, potassium bisulfite, sodium metabisulfite, and potassium metabisulfite and carbonyl bisulfite adduct may be added as required as preservatives.

The preferable rate of addition of preservatives is 0.5–10 g per 1 L of the color developer, and more preferably 1–5 g.

It is preferable to add various hydroxyl amines (for example, compounds described in JP-A-63-5341 and JP-A-63-106655, particularly, those containing sulfo groups and carboxy groups are preferable), hydroxamic acids described in JP-A-63-43138, hydrazines and hydrazides described in JP-A-63-146041, phenols described in JP-A-63-44657 and JP-A-63-58443, α-hydroxyketones and α-aminoketones described in JP-A-63-44656 and/or various saccharides described in JP-A-63-36244 as compound which directly preserves the aromatic primary amine color developing agent. In combination with the above-mentioned compounds, it is preferable to use monoamines described in JP-A-63-4235, JP-A-63-24254, JP-A-63-21647, JP-A-63-146040, JP-A-63-27841, and JP-A-63-25654, diamines described in JP-A-63-30845, JP-A-63-14640, and JP-A-63-43139, polyamines described in JP-A-63-21647, JP-A-63-26655, and JP-A-63-44656, nitroxy radicals described in JP-A-63-53551, alcohols described in JP-A-63-43140 and JP-A-63-53549, oxime described in JP-A-63-56654, and tertiary amines described in JP-A-63-239447.

In addition to the above-mentioned preservatives, various metals described in JP-A-57-44148 and JP-A-57-53749, salicylic acids described in JP-A-59-180588, alkanolamines described in JP-A-54-3582, polyethylene imines described in JP-A-56-94349, and aromatic poly hydroxy compounds described in U.S. Pat. No. 3,746,544 may be contained as required. In particular, the addition of aromatic poly hydroxy compound is preferable.

In the present invention, the pH of the color developer is set in the range of 9.5–12 but more than 10.2 is preferable, and in particular, the range 10.5–11.5 is most preferable in view of the increased speed.

It is possible to promote silver development and color-forming reactions by increasing the pH, and, in particular, this is effective in promoting color development of cyan dye.

In order to increase the pH, it is preferable to increase the amount of alkali buffers such as potassium carbonate and trisodium phosphate as well as increasing the addition amount of alkaline metal hydroxides such as potassium hydroxide and sodium hydroxide. The amount of these buffers should be 0.2 mol to 1.0 mole per 1 L of the developer, and more preferably 0.3 mol to 0.8 mol, and particularly preferably 0.35 mol to 0.5 mol.

The development may take place in two or more baths with varying pH. For example, the first bath is prepared with the developer of the pH 9 or lower and the work may be treated in a very short time, then it is treated in the developer of high pH exceeding 10.5, with a view to adjusting the balance of development progress in the top and bottom layers.

It is desirable to use various buffers to maintain the above pH levels.

Examples of buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodiumm o-hydroxybenzoate (sodium salicylate), potassiumm o-hydroxybenzoate, sodium 5-sulfo-2-hydroxybenzoate (sodium 5-sulfosalicylate), and potassiumm 5-sulfo-2-hydroxybenzoate (potassium 5-sulfosalicylate). However, the present invention should not be limited by these compounds.

It is preferable to add buffers to the color developer at the rate of more than 0.1 mol/L, and, in particular, 0.1–0.4 mol/L is most preferable.

In addition, in the color developer various chelating agents may be used as precipitation preventives for calcium and magnesium or to improve stability of the color developer.

Organic acid compounds are preferable for chelating agents. Examples include amino polycarboxylic acids, organic phosphonic acids, and phosphono carboxylic acids. Typical examples include nitrilotriacetic acid, diethylenetriamine pentaacetic acid, ethylenediaminetetraacetic acid, N,N,N-trimethylene phosphonic acid, ethylenediamine-N,N,N',N'-tetramethylene phosphonic acid, trans-cyclohexane diaminetetraacetic acid, 1,2-diaminopropane tetraacetic acid, hydroxyethyl iminodiacetic acid, glycol ether diaminetetraacetic acid, etylenediamine orthohydroxy phenylacetic acid, 2-phosphono butane-1,2,4-tricarboxylic acid, and 1-hydroxyethylidenel-1,1-diphosphonic acid, N,N'-bis(2-hydroxybenzyl)ethylendiamine-N,N'-diacetic acid. These chelating agents may be used in two or more combinations as required. These chelating agents are added enough to block metallic ions in the color developer, for example, at about 0.1 g to 10 g per 1 L.

To the color developer, 0.02 mol/L or less of bromide is added to prevent fog and adjust tones, but it is preferable to add 0.015 mol/L or less to accelate development. As examples of the bromide, alkaline metallic bromides such as potassium bromide, sodium bromide, and lithium bromide are preferable to use.

Various antifoggants can be used to prevent fog and improve discrimination. Preferable examples of antifoggants include organic antifoggants listed in Page 39 to 42 of PHOTOGRAPHIC PROCESSING CHEMISTRY, 2nd Edition (issued in 1975) written by L. F. Mason, such as benzotriazole, 5-methylbenzoriazole, 6-nitrobenzimidazole, 5-phenyltetrazole, 1-phenyl-5-mercaptotetrazole, and the like, and it is preferable to use the antifoggants in the amount specified in the same publication.

4-hydroxy-6-methyl-1,3,3a,7-tetraazaindene listed in Page 398 to 399 of THE THEORY OF PHOTOGRAPH, 4th Edition written by T. H. James is also preferable and is used at the rate equivalent to the aforementioned organic antifoggants.

To accelerate development, it is desirable to use various developing accelerators in color developers. For these developing accelerators, the combined use of the compounds listed in Page 41 to 44 of the book written by L. F. A. Mason and various black and white developing agents listed in Page 15 to 29 of the same book, but among all, examples of particularly preferable accelerators include pyrazolidones such as 1-phenyl-3-pyrazolidone, p-aminophenols, and tetramethyl-p-phenylenediamines.

It is preferable to use these developing accelerators at the rate of 0.001 g to 0.1 g per 1 L of the developer, and more preferable to use at the rate of 0.003 g to 0.05 g.

The color developer used in the present invention may contain fluorescent brighteners. For the fluorescent brightener, 4,4'-diamino-2,2'-disulfostilbene-based compounds are preferable. The rage of addition is 0–5 g/L, and preferably 0.1–4 g/L.

It is allowed to add various surfactants such as alkyl sulfonic acid, aryl sulfonic acid, aliphatic carboxylic acid, aromatic carboxylic acid, and the like as required.

Color development in the present invention is carried out at 40° C. or higher, more preferably at 45° C.–50° C. The treatment time should be 20 sec. to 5 min., preferably 30 sec. to 3 min. and 20 sec., and more preferably 1 min. to 2 min. and 30 sec.

In this invention, the preferable color developing time is 150 sec. or shorter. In this case, the developing time means the period between the time when the end of a light sensitive material is first soaked into the color developer and the time when it is first soaked in the photographic processing solution of the subsequent process, and includes the time in air when the light-sensitive material moves in air from process to process.

In general, the time in air is 1 sec. to 30 sec., but to achieve rapid development which this invention aims at, it is desirable to have the time in air as short as possible, and specifically it is desirable to be 15 sec. or less, and more preferably 10 sec. or less.

The effect of this invention is more markedly exhibited in the shorter processing time. From this viewpoint, it is desirable to be 120 sec. or less, and further it is the most preferable to be 100 sec. or less.

The color developer bath may be divided into two or more baths, and filling the replenisher for color developer from either the bath o the top front row or the last bath to shorten the developing time or reduce the volume of replenisher.

The processing method of this invention may be applied to the color reversal processing. The black and white developer used in such case is one which is called the black and white first developer to be used in reversal processing of color light-sensitive materials and which may contain various well-known additive used in the black and white developer to be used for the processing solution of black and white silver halide light-sensitive materials.

Typical examples of the additives include developing agents such as 1-phenyl-3-pyrazolidone, metol, and hydroquinone, preservative such as sulfite, accelerators comprising alkalines such as sodium hydroxide, sodium carbonate, potassium carbonate, and the like, inorganic or organic restrainers such as potassium bromide, 1-methylbenzimidazole, methylbenzthiazole, and the like, hard water softerner such as polyphosphate, and development restrainers such as traces of iodide and mercapto compounds.

When processing is carried out with an automatic developing machine using the above developer, the smaller the area (opening area) which the developer comes in contact with air, the better. For example, if the opening ratio is the value obtained by dividing the opening area ($m^2$) by the volume of the developer ($cm^3$), the opening ratio is preferably 0.01 or less, more preferably 0.005 or less.

It is desirable to add water equivalent to the amount of evaporated water in order to correct thicknening of the developer caused by evaporation.

This invention is also effective when the developer is recovered for reuse.

It is desirable to use continuously the color developer in this invention by supplying the replenisher. The replenisher contains a necessary amount of components which are consumed during development and with time. Consequently, as compared to the mother developer, in general, the replenisher contains a slightly larger amount of components. The ratio is, in general, 10–15% larger than that of the mother developer.

However, because bromide elutes from the light-sensitive material as development takes place, it is desirable to set the content of the replenisher to the volume smaller than that of the mother solution, and it is desirable to reduce the contents as the volume of replenisher is reduced. For example, it is desirable to set the volume of replenisher to 1,000 ml or less, preferably, 1,000–100 ml per 1 $m^2$ of the light-sensitive material. In that event, the content of bromide is desirable to restrict to 0.004 mol or lower per 1 L, and when the replenisher is 500 ml or less, it is desirable to keep the content to 0.03 mol or lower. If the volume of the replenisher is further reduced, it is desirable not to contain any bromide.

The color developer is prepared by dissolving the above compounds in water. It is desirable to use softened water, and in particular, water of electric conductivity of 10 μs/cm or less, which is distilled or deionized with ion exchange resin or reverse osmosis membrane.

The pH of these color developers is, in general, 9–12. The volume of replenisher for these developers is, in general, 3 L or less per 1 $m^2$ of light-sensitive material, though this differs according to color photographic sensitive materials to be processed, and this can be reduced to 500 ml or less by keeping the bromide ion concentration in the replenisher at low level. In reducing the volume of replenisher, it is desirable to prevent evaporation of the solution and oxidation by air by reducing the area which is brought in contact with air in the processing tank. Using a means to prevent accumulation of bromide ion in the developer, the volume of replenisher can be reduced.

The photographic emulsion layer after color development generally undergoes the bleaching process. Bleaching may be carried out simultaneously with fixing processing (bleach-fixing processing) or may be carried out individually. In addition, in order to accelerate processing, it can be bleach-fixed after bleaching. Furthermore, processing in the bleach-fixing baths consisting of two continuous baths, fixing before bleach-fixing processing, or bleaching after bleach-fixing processing can be carried out optionally according to purposes. Examples of bleaching agent include polyvalent metal compounds such as iron (III), cobalt (III), chromium (VI), copper (II), and the like, peracids, quinones, and nitro compounds. Examples of typical bleaching agent include ferricyanides; bichromates; organic complex salts such as iron (III) or cobalt (III), complex salts such as amino polycarboxylic acids including ehylenediaminetetracetic acid, diethylenetriaminepentaacetic acid, cyclohexanediaminetetraacetic acid, methyliminodiacetic acid, 1,3-diaminopropane tetraacetic acid, and the like, or citric acid, tartaric acid, and malic acid; persulfate, bromate, permanganate, nitrobenzenes. Among these, ethylene diamine tetraacetic acid iron (III) complex salt as well as amino polycarboxylic acid iron (III) complex salt, and persulfate are desirable from viewpoint of rapid processing and prevention of environmental pollution. In addition, aminopolycarboxylic acid iron (III) complex salt is particularly useful in both bleach and bleach-fixing solution. The pH of the bleach or bleach-fixing solution using these aminopolycarboxylic acid iron (III) complex salt is, in general, 5.5 to 8, but for more rapid processing, it is possible to process at the even lower pH.

Bleach accelerators may be used in bleach, bleach-fixing solution, and their pre-baths as required. Specific examples of useful bleach accelerators include compounds containing mercapto groups or disulfide bonding mentioned in the specifications of U.S. Pat. No. 3,893,858, FRG P. No. 1,290,812, JP-A-53-95,630, Research Disclosure No. 17,129 (July 1978); thiazolidine derivatives mentioned in JP-A-50-140,129; thiourea derivatives mentioned in U.S. Pat. No. 3,706,561; iodide salts mentioned in JP-A-58-16,235; polyoxyethylene compound mentioned in FRG P. No. 2,748,430; polyamide compounds mentioned in JP-B-45-8836; and bromide ions. Among all, compounds containing mercapto groups or disulfide bonding are desirable in view or large acceleration effect, in particular, the compounds mentioned in U.S. Pat. No. 3,893,858, FRG P. No. 1,290,812, and JP-A-53-95,630 are desirable. In addition, compounds mentioned in U.S. Pat. No. 4,552,834 are desirable. These bleach accelerators may be added into light-sensitive materials. These bleach accelerators are especially effective when bleach-fixing color sensitive materials for photographs.

Examples of fixing agents include thiosulfate, thiocyanate, thioether-based compounds, thioureas, and a large amount of iodides, but the use of thiosulfate is most popular, and in particular, ammonium thiosulfate can be used most extensively. As preservatives for the bleach-fixing solution, sulfite, bisulfite, sulfonic acids or carbonyl bisulfite addition products are preferable.

Water washing and/or stabilizing

Upon completion of bleach-fixing processing, the material undergoes processes for water washing and stabilizing. According to types and applications of sensitized materials, several methods can be selected, such as direct drying after water washing, processing with the stabilizing agent before drying, or directly processing with the stabilizing agent without water washing and drying.

The solution used for water washing in this invention may be simple water such as tap water, well water, distilled water, or deionized water, but in order to increase water-washing effects, various known compounds such as sodium sulfate, magnesium chloride, and the like can be added. The pH of the water-washing solution is, in general, 5–8 but the pH of the solution may be adjusted to 5 or less to be acidic or 8 or more to be alkaline to promote water-washing effect. For another water-washing promotion means, anionic or cationic surface active agents may be added. In addition, compounds mentioned in Page 207–223 of J. Antibact. Antifug. Agents, Vol, 11, No. 5 (1983) and CHEMISTRY FOR ANTIBACTERA AND ANTIMILDEW written by Hiroshi Horiguchi may be added. Among all, isothiazoline-based compounds such as 5-chloro-2-methyl-4-isothiazoline-3-one, triazole derivatives such as benzotriazole, and active halogen releasing compounds such as sodium dichloroisocyanurate exhibit excellent effects on preventing putrefaction of water during storage. In addition, water softeners such as ethylenediaminetetraacetic acid and nitrilotriacetc acid are also used.

To the stabilizing solution, all compounds which can be added to the water washing solution can be added and, further, compounds having the image stabilizing effect can be added. Examples include aldehyde compounds such as formalin, ammonium compounds such as ammonium chloride, and fluorescent brighteners. The pH of the stabilizing solution is, in general, 4–8 but the low pH range of 3–5 may be preferably used according to the type of light-sensitive materials and application purposes.

The present invention will be described in more detail by way of the following examples.

EXAMPLE 1

A solution in which potassium bromide, thioether ($HO(CH_2)_2S(CH_2)_2S(CH_2)_2OH$), and gelatin were dissolved was maintained at 70° C., and a silver nitrate solution and a solution mixture of potassium iodide and potassium bromide were added to the solution under stirring by a double jet method.

After the addition, the resultant solution mixture was cooled to 35° C., and soluble salt was removed by a conventional flocculation method. Thereafter, the temperature was increased to 40° C., and 60 g of gelatin were added and dissolved and the pH was adjusted to be 6.8.

The obtained tabular silver halide grains had an average diameter of 1.25 μm, a thickness of 0.17 μm, and an average diameter/thickness ratio of 7.4 and contained 3 mol % of silver iodide. The pAg of the grains was 8.4 at 40° C.

This emulsion was divided into 12 parts and heated up to 62° C. A sensitizing dye anhydro-5,5'-dichloro-9-ethyl-3,3'-di(3-sulfopropyl)oxacarbocyaninehydrooxide sodium salt (500 mg/mol of AgX) and potassium iodide (200 mg/mol of AgX) were added to the emulsions, and sensitizing dyes listed in Table 1 were added. In addition, chloroauric acid ($9\times10^{-6}$ mol/mol of AgX) and potassium thiocyanate ($3.2\times10^{-4}$ mol/mol of AgX) were added, and compounds listed in Table 1 were added, thereby performing chemical ripening for 30 minutes.

After completion of the chemical ripening, 100 g (containing 0.08 mol of Ag) of each emulsion were dissolved at 40° C., and the following solutions i) to iv) were sequentially added to the emulsion while stirring.

| | | | |
|---|---|---|---|
| i) | 4-hydroxy-6-methyl-1,3,3a,7-tetrazaindene | 3% aqueous solution | 2 cc |
| ii) | $C_{17}H_{35}$—O—$(CH_2CH_2O)_{25}$—H | 2% aqueous solution | 2.2 cc |
| iii) | Compound C-1) | 2% aqueous solution | 1.6 cc |
| iv) | Sodium 2,4-dichloro-6-hydroxy-s-triazine | 2% aqueous solution | 3 cc |

A coating solution for surface protective layer was prepared by sequentially adding the following solutions i) to v) at 40° C. while stirring.

| i) to v) at 40° C. while stirring. | | | |
|---|---|---|---|
| i) | 14% aqueous gelatin solution | | 56.8 g |
| ii) | Polymethylmethacrylate fine particles (average grain size = 3.0 μm) | | 3.9 g |
| iii) | Emulsifier | | |
| | Gelatin | 10% aqueous solution | 4.24 g |
| | Compound (C-2) | | 10.6 mg |
| | Phenol | 72% aqueous solution | 0.02 cc |
| | Compound (C-3) | | 0.424 g |
| iv) | Water | | 68.8 cc |
| v) | Compound (C-4) | 4.3% aqueous solution | 3 cc |

Chemical structures of the compounds (C-1) to (C-4) are listed in Table C to be presented later.

Each coating solution of emulsion prepared as described above and the coating solution for surface protective layer were coated on a polyethyleneterephthalate film support by a co-extrusion method so that a volume ratio upon coating was 103:45. A coating silver amount was 2.5 g/m². These samples were exposed (1/100 sec.) by using a sensitometer through a yellow filter and an optical wedge, and developed by a developing solution RD-III (available from Fuji Photo Film Co., Ltd.) for an automatic developing machine at 35° C. for 30 seconds. Thereafter, each sample was fixed, washed with water, and dried by conventional methods, and its photographic sensitivity was measured. The photographic sensitivity wa represented by a relative value of a reciprocal of an exposure amount required to obtain an optical density of a fog value +0.2 assuming that the sensitivity of a sample 1 was 100.

As is apparent from Table 1, compared to sulfur-gold sensitization, selenium-gold sensitization or selenium-sulfur-gold sensitization provided high sensitivity but produced a large amount of fog. However, the use of the compounds of the present invention significantly suppressed the production of fog and decreased a reduction in sensitivity to be smaller than that predicted to be obtained in sulfur-gold sensitization. That is, low fog and high sensitivity were able to be obtained by the selenium sensitization.

In addition, significantly low fog and the highest sensitivity were obtained in a sample 12 using both of compounds represented by formulas (II) and (III).

TABLE 1

| Sample No. | Sensitizer (Addition Amount) | Compound of Present Invention Compound No.* (Addition Amount) | Fog | Relative Sensitivity | Relationship with Present Invention |
|---|---|---|---|---|---|
| 1 | Sodium thiosulfate ($1.8\times10^{-5}$) | — | 0.14 | 100 | Comparative Example |
| 2 | Sodium thiosulfate ($1.8\times10^{=5}$) | 18 ($1\times10^{-4}$) | 0.12 | 85 | Comparative Example |
| 3 | N,N-dimethyl selenourea ($2\times10^{-6}$) | — | 0.36 | 145 | Comparative Example |
| 4 | N,N-dimethyl selenourea ($2\times10^{-6}$) | 18 ($1\times10^{-4}$) | 0.11 | 132 | Present Invention |
| 5 | N,N-dimethyl selenourea ($2\times10^{-6}$) | 12 ($4\times10^{-4}$) | 0.09 | 135 | Present Invention |
| 6 | N,N-dimethyl selenourea ($2\times10^{-6}$) | 6 ($6.5\times10^{-3}$) | 0.10 | 130 | Present Invention |
| 7 | N,N-dimethyl selenourea ($2\times10^{-6}$) | 1 ($6.5\times10^{-3}$) | 0.09 | 130 | Present Invention |
| 8 | N,N-diethyl selenourea ($3\times10^{-6}$) | — | 0.45 | 150 | Comparative Example |
| 9 | N,N-diethyl selenourea ($3\times10^{-6}$) | 14 ($2\times10^{-4}$) | 0.08 | 136 | Present Invention |
| 10 | N,N-dimethyl selenourea ($1\times10^{-6}$) Sodium thiosulfate ($8\times10^{-6}$) | — | 0.32 | 135 | Comparative Example |
| 11 | N,N-dimethyl selenourea ($1\times10^{-6}$) Sodium thiosulfate ($8\times10^{-6}$) | 28 ($2\times10^{-3}$) | 0.07 | 130 | Present Invention |
| 12 | N,N-dimethyl selenourea ($1\times10^{-6}$) Sodium thiosulfate | 14' ($1\times10^{-4}$) 28 ($1\times10^{-4}$) | 0.07 | 157 | Present Invention |

TABLE 1-continued

| Sample No. | Sensitizer (Addition Amount) | Compound of Present Invention Compound No.* (Addition Amount) | Fog | Relative Sensitivity | Relationship with Present Invention |
|---|---|---|---|---|---|
| | ($8 \times 10^{-6}$) | | | | |

*Compounds are respresnted by compound numbers shown in Table B

In Table 1, the addition amounts of sensitizers and compounds of the present invention are represented in units of mols per mol of silver.

EXAMPLE 2

Silver Iodobromide Tabular Grain

Silver Iodobromide Fine Grain Emulsion II-A 1,200 ml of a 1.2-mol silver nitrate solution and 1,200 ml of an aqueous halide solution containing 1.11 mols of potassium bromide and 0.09 mols of potassium iodide were added to 2.6 liters of a 2.0-wt % gelatin solution containing 0.026 mols of potassium bromide under stirring by the double jet method over 15 minutes. During the addition, the temperature of the gelatin solution was held at 35° C. Thereafter, the emulsion was washed by the conventional flocculation method, 30 g of gelatin were added and dissolved, and the pH and the pAg were adjusted to be 6.5 and 8.6, respectively. The obtained silver iodobromide fine grains (silver iodide content = 7.5 mol %) had an average grain size of 0.07 μm.

Tabular Silver Bromide Core Emulsion II-B 30 cc of a 2.0-mol silver nitrate solution and a 2.0-mol potassium bromide solution were added to two liters of a 0.8-wt % gelatin solution containing 0.09-mol potassium bromide under stirring by the double jet method. During the addition, the temperature of the gelation solution in a reactor vessel was held at 30° C. After the addition, the temperature was increased to 75° C., and 40 g of gelatin were added. Thereafter, a 1.0-mol silver nitrate solution was added to adjust the pBr to be 2.55. Subsequently, 150 g of silver nitrate were added at an accelerated flow rate (a flow rate at the end of addition was 10 times that at the beginning) over 60 minutes, and at the same time a potassium bromide solution was added by the double jet method to adjust the pBr to be 2.55

Thereafter, the resultant emulsion was cooled to 35° C. and washed with water by the conventional flocculation method. 60 g of gelatin were added and dissolved at 40° C. and the pH and the pAg were adjusted to be 6.5 and 8.6, respectively. The obtained tabular silver bromide grains were monodisperse tabular grains having an average circle-equivalent diameter of 1.4 μm, a grain thickness of 0.2 μm, and a variation coefficient of a circle-equivalent diameter of 15%.

Tabular Silver Iodobromide Emulsion II-C

The emulsion II-B containing silver bromide corresponding to 50 g of silver nitrate was dissolved in 1.1 liters of water, and the temperature and the pBr were held at 75° C. and 1.5, respectively. Subsequently, 1 g of 3,6-dithiaoctane-1,8-diol was added, and the fine grain emulsion II-A was added to the reactor vessel at a constant flow rate over 50 minutes so that 100 g of silver nitrate were added. The obtained tabular grains had an average circle-equivalent diameter of 2.4 μm and a grain thickness of 0.31 μm.

Thereafter, the emulsion was washed with water by the conventional flocculation method and the pH and the pAg were adjusted to be 6.5 and 8.6, respectively.

The obtained emulsion was divided into seven parts and heated up to 56° C. After a sensitizing dye anhydro-5-chloro-5'-phenyl-9-ethyl-3,3'-di(3-sulfopropyl)oxacarbocyaninehydrooxide sodium salt was added, compounds and sensitizers listed in Table 2 were added, and chloroauric acid ($1 \times 10^{-5}$ mol/mol of AgX) and potassium thiocyanate ($6 \times 10^{-4}$ mol/mol of AgX) were added to optimally perform chemical sensitization. Subsequently, the following compounds were added, and the resultant emulsion was coated together with solution for protective layers on triacetylcellulose film supports having undercoating layers by the co-extrusion method, thereby forming samples 13 to 19.

(1) Emulsion Layer

Emulsion . . . emulsions listed in Table 2
Coupler (coupler (D-1) shown in Table
Tricresylphosphate
Stabilizer
4-hydroxy-6-methyl-1,3,3a,7-tetrazaindene
Coating aid sodium dodecylbenzenesulfonate

(2) Protective Layer

Polymethylmethacrylate fine grains
2,4-dichloro-6-hydroxy-s-triazine sodium salt
Gelatin These samples were subjected to sensitometry exposure (1/100 sec.), and the following color development was performed.

The density of each developed sample was measured using a green filter. The results of obtained photographic properties are summarized in Table 2. The relative sensitivity is represented assuming that the sensitivity of the sample 13 is 100.

The development was performed under the following conditions at a temperature of 38° C.

| | |
|---|---|
| 1. Color development | 2 min. 45 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The compositions of processing solutions used in the above steps were as follows:

| | |
|---|---|
| Color Developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methyl-aniline sulfate | 4.5 g |
| Water to make | 1 l |
| Bleaching Solution: | |
| Ammonium bromide | 160.0 g |
| Ammonia water (28%) | 25.0 ml |
| Ethylenediaminetetraacetic acid sodium salt | 130 g |
| Glacial acetic acid | 14 ml |
| Water to make | 1 l |
| Fixing Solution: | |
| Sodium tetrapolyphosphate | 2.0 g |
| Sodium sulfite | 4.0 g |
| Ammonium thiosulfate (70%) | 175.0 ml |

-continued

| | |
|---|---|
| Sodium bisulfite | 4.6 g |
| Water to make | 1 l |
| Stabilizing Solution: | |
| Formalin | 8.0 ml |
| Water to make | 1 l |

TABLE 2

| Sample No. | Compound of Present Invention Compound No.* (Addition Amount) | Sensitizer (Addition (Amount) | Fog | Relative Sensitivity | Relationship with Present Invention |
|---|---|---|---|---|---|
| 13 | — | Sodium thiosulfate ($1.2 \times 10^{-5}$) | 0.28 | 100 | Comparative Example |
| 14 | 18 ($1 \times 10^{-4}$) | Sodium thiosulfate ($1.2 \times 10^{-5}$) | 0.20 | 85 | Comparative Example |
| 15 | — | N,N-dimethyl selenourea ($2 \times 10^{-6}$) | 0.65 | 150 | Comparative Example |
| 16 | 18 ($1 \times 10^{-4}$) | N,N-dimethyl selenourea ($2 \times 10^{-6}$) | 1.18 | 145 | Present Invention |
| 17 | 18 ($2 \times 10^{-4}$) | N,N-dimethyl selenourea ($2 \times 10^{-6}$) | 0.16 | 140 | Present Invention |
| 18 | 12 ($2 \times 10^{-4}$) | N,N-dimethyl selenourea ($2 \times 10^{-6}$) | 0.16 | 140 | Present Invention |
| 19 | 18 ($1 \times 10^{-4}$) 40 ($1 \times 10^{-4}$) | N,N-dimethyl selenourea ($2 \times 10^{-6}$) | 0.15 | 155 | Present Invention |

*Compounds are represented by compound numbers shown in Table B

In Table 2, the addition amounts of sensitizers and compounds of the present invention are represented in units of mols per mol of silver.

EXAMPLE 3

(1) Preparation of Emulsion

Emulsion A-1

1.0 liter of a 0.7% aqueous solution (solution A) of inactive bone gelatin containing 0.57 mols (per liter of a solution; the same shall apply hereinafter) of potassium bromide was stirred at a temperature of 30° C., and a 1.95-mol aqueous solution (solution B) of potassium bromide and 1.9-mol aqueous solution (solution C) of silver nitrate were added to the solution A under stirring by the double jet method at the same constant flow rate over 30 seconds (2.06% of the entire silver nitrate were consumed). 400 ml of an 8% deionized gelatin solution were added, and the temperature was increased to 75° C. A 1.12-mol aqueous solution (solution D) of silver nitrate was added to adjust the pBr to be 2.13 (1.84% of the entire silver nitrate were consumed), and a 14.7-N aqueous ammonia solution was added to adjust the pH to be 8.3. After physical ripening was performed, 1-N nitric acid was added to adjust the pH to be 5.5. A 1.34-mol aqueous solution (solution E) of potassium bromide and the solution D were simultaneously added at an accelerated flow rate (a flow rate at the end of addition was 2.5 times that at the beginning) over 11 minutes while the pBr was maintained at 1.56 (12.8% of the entire silver nitrate were consumed), and 1-N NaOH was added to adjust the pH to be 9.3. An aqueous solution (solution F) containing 1.34 mols of potassium bromide and 0.108 mols of potassium iodide and the solution D were simultaneously added at a accelerated flow rate (a flow rate at the end of addition was 5.5 times that at the beginning) over 28.5 minutes while the pBr was maintained at 1.56 (67.3% of the entire silver nitrate were consumed). 100 cc of a 0.14-mol aqueous solution (solution G) of potassium iodide were added over 10 minutes, and 10 minutes after completion of the addition, the solution D and a 1.34-mol aqueous solution (solution H) of potassium bromide were simultaneously added at an accelerated flow rate (a flow rate at the end of addition was twice that at the beginning) over 10 minutes while the pBr was maintained at 2.42 (16% of the entire silver nitrate were consumed). The resultant emulsion was desalted by the conventional flocculation method to prepare tabular AgBrI grains (silver iodide =5 mol %) having an average grain diameter/thickness ratio of 6.5 and a sphere-equivalent diameter of 1.2 μm.

The obtained emulsion was divided into six parts and heated up to 56° C. After sensitizing dyes I to III shown in Table B were added to the emulsions, compounds and sensitizers listed in Table 3 were added, and chloroauric acid ($1.2 \times 10^{-5}$ mol/mol of Ag) and potassium thiocyanate ($4.0 \times 10^{-4}$ mol/mol of Ag) were added to optimally perform ripening to prepare emulsions 20 to 25. "Optimally" means that the highest sensitivity was obtained when 1/100-sec exposure was performed.

Formation of Samples

The emulsions 20 to 25 were coated on TAC (triacetylcellulose) bases under the following coating conditions to form samples 20 to 25.

| Emulsion Coating Conditions | |
|---|---|
| (1) Emulsion Layer | |
| Emulsion . . . various types of emulsions (emulsions 20 to 25) | silver $2.1 \times 10^{-2}$ mol/m$^2$) |
| Coupler (E-1) | ($1.5 \times 10^{-3}$ mol/m$^2$) |
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours and exposed through a gelation filter YF available from Fuji Photo Film Co., Ltd. and a continuous wedge for 1/100 second, and the following color development was performed.

The density of each developed sample was measured using a green filter.

| Step | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The processing solution compositions will be described below.

| | (g) |
|---|---|
| (Color Developing Solution) | |

-continued

| | (g) |
|---|---|
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water to make | 1.0 l |
| pH | 10.05 |
| (Bleach-Fixing Solution) | |
| Ferric ammonium ethylenediaminetetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator (E-2) | 0.01 mol |
| Water to make | 1.0 l |
| pH | 6.0 |
| (Washing Solution) | |
| Tap water was supplied to a mixed-bed column filled with an H type strongly acidic cation exchange resin (Amberlite IR-120B: available from Rohm & and House Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 1.5 g/l of sodium sulfate were added. The pH of the solution fell within the range of 6.5 to 7.5. | |
| (Stabilizing Solution) | |
| Formalin (37%) | 2.0 ml |
| Polyoxyethylene-p-monononyl-phenylether (average polymerization degree = 10) | 0.3 |
| Disodium ethylenediaminetetraacetate | 0.05 |
| Water to make | 1.0 l |
| pH | 5.0 to 8.0 |

Chemical structures of the coupler (E-1) and the bleaching accelerator (E-2) are shown in Table E to be presented later.

In Table 3, the sensitivity is represented by a relative value of a reciprocal of an exposure amount (lux.sec.) for giving a density of fog+0.2.

TABLE 3

| Sample No. | Sensitizer (Addition Amount) | Compound of Present Invention Compound No.* (Addition Amount) | Fog | Relative Sensitivity | Relationship with Present Invention |
|---|---|---|---|---|---|
| 20 | Sodium thiosulfate ($1.6 \times 10^{-5}$) | — | 0.20 | 100 | Comparative Example |
| 21 | Sodium thiosulfate ($1.6 \times 10^{-5}$) | 12 ($1 \times 10^{-4}$) | 0.17 | 75 | Comparative Example |
| 22 | N,N-dimethyl selenourea ($3 \times 10^{-6}$) | — | 0.62 | 130 | Comparative Example |
| 23 | N,N-dimethyl selenourea ($3 \times 10^{-6}$) | 12 ($6 \times 10^{-4}$) | 0.14 | 120 | Present Invention |
| 24 | N,N-dimethyl selenourea ($3 \times 10^{-6}$) | 18 ($4 \times 10^{-4}$) | 0.16 | 125 | Present Invention |
| 25 | N,N-dimethyl selenourea ($3 \times 10^{-6}$) | 12 ($1 \times 10^{-4}$) 43 ($3 \times 10^{-4}$) | 0.13 | 148 | Present Invention |

*Compounds are represented by compound numbers shown in Table B

In Table 3, the addition amounts of sensitizers and compounds of the present invention are represented in units of mol per mol of silver.

As is apparent from Table 3, when the compounds of the present invention were used in the gold-selenium sensitization which produced a large amount of fog by color developing at 40° C., the production of fog was significantly suppressed and the high sensitivity was able to be maintained.

EXAMPLE 4

A plurality of layers having the following compositions were coated on an undercoated triacetylcellulose film support, in which the emulsion 25 described in Example 3 was used as the emulsion of the layer 7, thereby forming a sample A.

Compositions of Light-Sensitive Layers

Numerals corresponding to each component indicates a coating amount represented in units of g/m$^2$ The coating amount of a silver halide is represented by the coating amount of silver. The coating amount of a sensitizing dye is represented in units of mols per mol of a silver halide in the same layer.

| | | |
|---|---|---|
| (Sample A) | | |
| Layer 1: Antihalation Layer | | |
| Black colloidal silver | silver | 0.18 |
| Gelatin | | 1.40 |
| Layer 2: Interlayer | | |
| 2,5-di-t-pentadecylhydroquinone | | 0.10 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| Gelatin | | 1.04 |
| Layer 3: Donor Layer Having Interlayer | | |

-continued

| | | |
|---|---|---|
| Effect On Red-Sensitive Layer | | |
| Emulsion J | silver | 1.2 |
| Emulsion K | silver | 2.0 |
| Sensitizing dye IV | | $4 \times 10^{-4}$ |
| EX-10 | | 0.10 |
| HBS-1 | | 0.10 |
| HBS-2 | | 0.10 |
| Layer 4: Interlayer | | |
| EX-5 | | 0.040 |
| HBS-1 | | 0.020 |
| Gelatin | | 0.80 |
| Layer 5: 1st Red-Sensitive Emulsion Layer | | |
| Emulsion A | silver | 0.25 |
| Emulsion B | silver | 0.25 |
| Sensitizing dye I | | $1.5 \times 10^{-4}$ |
| Sensitizing dye II | | $1.8 \times 10^{-5}$ |
| Sensitizing dye III | | $2.5 \times 10^{-4}$ |
| EX-2 | | 0.335 |
| EX-10 | | 0.020 |
| U-1 | | 0.07 |
| U-2 | | 0.05 |
| U-3 | | 0.07 |
| HBS-1 | | 0.060 |
| Gelatin | | 0.87 |
| Layer 6: 2nd Red-Sensitive Emulsion Layer | | |
| Emulsion G | silver | 1.0 |
| Sensitizing dye I | | $1.0 \times 10^{-4}$ |
| Sensitizing dye II | | $1.4 \times 10^{-5}$ |
| Sensitizing dye III | | $2.0 \times 10^{-4}$ |
| EX-2 | | 0.400 |
| EX-3 | | 0.050 |
| EX-10 | | 0.015 |
| U-1 | | 0.07 |
| U-2 | | 0.05 |
| U-3 | | 0.07 |
| Gelatin | | 1.30 |
| Layer 7: 3rd Red-Sensitive Emulsion Layer | | |
| Emulsion 25 | silver | 1.60 |
| Sensitizing dye I | | $1.0 \times 10^{-4}$ |
| Sensitizing dye II | | $1.4 \times 10^{-5}$ |
| Sensitizing dye III | | $2.0 \times 10^{-4}$ |
| EX-3 | | 0.010 |
| EX-4 | | 0.080 |
| EX-2 | | 0.097 |
| HBS-1 | | 0.22 |
| HBS-2 | | 0.10 |
| Gelatin | | 1.63 |
| Layer 8: Interlayer | | |
| EX-5 | | 0.040 |
| HBS-1 | | 0.020 |
| Gelatin | | 0.80 |
| Layer 9: 1st Green-Sensitive Emulsion Layer | | |
| Emulsion A | silver | 0.15 |
| Emulsion B | silver | 0.15 |
| Sensitizing dye V | | $3.0 \times 10^{-5}$ |
| Sensitizing dye VI | | $1.0 \times 10^{-4}$ |
| Sensitizing dye VII | | $3.8 \times 10^{-4}$ |
| Sensitizing dye IV | | $5.0 \times 10^{-5}$ |
| EX-6 | | 0.260 |
| EX-1 | | 0.021 |
| EX-7 | | 0.030 |
| EX-8 | | 0.005 |
| HBS-1 | | 0.100 |
| HBS-3 | | 0.010 |
| Gelatin | | 0.63 |
| Layer 10: 2nd Green-Sensitive Emulsion Layer | | |
| Emulsion C | silver | 0.45 |
| Sensitizing dye V | | $2.1 \times 10^{-5}$ |

-continued

| | | |
|---|---|---|
| Sensitizing dye VI | | $7.0 \times 10^{-5}$ |
| Sensitizing dye VII | | $2.6 \times 10^{-4}$ |
| Sensitizing dye IV | | $5.0 \times 10^{-5}$ |
| EX-6 | | 0.094 |
| EX-22 | | 0.018 |
| EX-7 | | 0.026 |
| HBS-1 | | 0.160 |
| HBS-3 | | 0.008 |
| Gelatin | | 0.50 |
| Layer 11: 3rd Green-Sensitive Emulsion Layer | | |
| Emulsion D | silver | 1.2 |
| Sensitizing dye IV | | $0.5 \times 10^{-5}$ |
| EX-13 | | 0.015 |
| EX-11 | | 0.100 |
| EX-1 | | 0.025 |
| HBS-1 | | 0.25 |
| HBS-2 | | 0.10 |
| Gelatin | | 1.54 |
| Layer 12: Yellow Filter Layer | | |
| Yellow Colloidal Silver | silver | 0.05 |
| EX-5 | | 0.08 |
| HBS-1 | | 0.03 |
| Gelatin | | 0.95 |
| Layer 13: 1st Blue-Sensitive Emulsion Layer | | |
| Emulsion A | silver | 0.08 |
| Emulsion B | silver | 0.07 |
| Emulsion F | silver | 0.07 |
| Sensitizing dye VIII | | $3.5 \times 10^{-4}$ |
| EX-9 | | 0.721 |
| EX-8 | | 0.042 |
| HBS-1 | | 0.280 |
| Gelatin | | 1.10 |
| Layer 14: 2nd Blue-Sensitive Emulsion Layer | | |
| Emulsion C | silver | 0.45 |
| Sensitizing dye VIII | | $2.1 \times 10^{-4}$ |
| EX-9 | | 0.154 |
| EX-10 | | 0.007 |
| HBS-1 | | 0.05 |
| Gelatin | | 0.78 |
| Layer 15: 3rd Blue-Sensitive Emulsion Layer | | |
| Emulsion H | silver | 0.77 |
| Sensitizing dye VIII | | $2.2 \times 10^{-4}$ |
| EX-9 | | 0.20 |
| HBS-1 | | 0.07 |
| Gelatin | | 0.69 |
| Layer 16: 1st Protective Layer | | |
| Emulsion I | silver | 0.20 |
| U-4 | | 0.11 |
| U-5 | | 0.17 |
| HBS-1 | | 0.05 |
| Gelatin | | 1.00 |
| Layer 17: 2nd Protective Layer | | |
| Polymethylacrylate particles (diameter = about 1.5 μm) | | 0.54 |
| S-1 | | 0.20 |
| Gelatin | | 1.20 |

In addition to the above components, a gelatin hardener H-1, EX-14 to EX-21, and a surfactant were added to the individual layers.

The emulsions A to K used in the above light-sensitive material sample A are shown in Table 4, and formulas of the compounds used in the sample A are shown in Table F to be presented later.

TABLE 4

| Emulsion No. | Average AgI Content (%) | Average Grain Size (μm) | Variation Coefficient of Grain Size (%) | Diameter Thickness Ratio | Silver Amount Ratio (AgI Content %) |
|---|---|---|---|---|---|
| Emulsion A | 4.0 | 0.45 | 27 | 1 | core/shell = 1/3(13/1) double structure grain |
| Emulsion B | 8.9 | 0.70 | 14 | 1 | core/shell = 3/7(25/2) |

TABLE 4-continued

| Emulsion No. | Average AgI Content (%) | Average Grain Size (μm) | Variation Coefficient of Grain Size (%) | Diameter Thickness Ratio | Silver Amount Ratio (AgI Content %) |
|---|---|---|---|---|---|
| Emulsion C | 10 | 0.75 | 30 | 2 | double structure grain core/shell = 1/2(24/3) |
| Emulsion D | 16 | 1.05 | 35 | 2 | double structure grain core/shell = 4/6(40/0) |
| Emulsion F | 4.0 | 0.25 | 28 | 1 | double structure grain core/shell = 1/3(13/1) |
| Emulsion G | 14.0 | 0.75 | 25 | 2 | double structure grain core/shell = 1/2(42/0) |
| Emulsion H | 14.5 | 1.30 | 25 | 3 | double structure grain core/shell = 37/63(34/3) |
| Emulsion I | 1 | 0.07 | 15 | 1 | double structure grain uniform grain |
| Emulsion J | 5 | 0.90 | 30 | 2 | core/shell = 1/1(10/0) |
| Emulsion K | 7 | 1.50 | 25 | 2 | double structure grain core/shell = 1/1(14/0) double structure grain |

The sample A was left to stand at a temperature of 40° C. and a relative humidity of 70% for 14 hours and subjected to 1/100-sec. exposure through a continuous wedge, and color development was performed under the conditions shown in Table 5.

TABLE 5

| Processing Method | | | | |
|---|---|---|---|---|
| Process | Time | Temperature | Replenishing Amount* | Tank Volume |
| Color Development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 l | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilizing | 1 min. 05 sec. | 38° C. | 25 ml | 10 l |
| Drying | 4 min. 20 sec. | 55° C. | | |

*A replenishing amount per meter of a 35-mm wide sample

The compositions of the processing solutions will be presented below.

| | Mother Solution (g) | Replenishment Solution (g) |
|---|---|---|
| Color Developing Solution: | | |
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |
| Bleaching Solution: | | |
| Ferric Sodium ethylenediamine-tetraacetate trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |

-continued

| | Mother Solution (g) | Replenishment Solution (g) |
|---|---|---|
| Water to make | 1.0 l | 1.0 l |
| pH | 6.0 | 5.7 |
| Fixing Solution: | | |
| Sodium ethylene-diaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |
| Stabilizing Solution: | | |
| Formaline (37%) | 2.0 ml | 3.0 ml |
| Polyoxyethylene-p-mononononylphenylether (average polymerization degree = 10) | 0.3 | 0.45 |
| Disodium ethylene-diaminetetraacetate | 0.05 | 0.08 |
| Water to make | 1.0 l | 1.0 l |
| pH | 5.0–8.0 | 5.0–8.0 |

The density of the developed sample A was measured using a red filter to evaluate the fog and the sensitivity. As a result, it was confirmed that high sensitivity and low fog were achieved by the emulsion 25 of the present invention even in a multilayered color light-sensitive material, by developing with reduced replenishment rate.

EXAMPLE 5

When the emulsion 25 used in Example 4 was used in the layer 6 of the following sample B and the processing described below was performed, it was confirmed that high sensitivity similar to that shown in Example 3 was achieved even in a reversal multilayered color light-sensitive material.

Preparation of Sample B

Layers having the following compositions were coated on an undercoated 127-μm thick triacetylcellulose film support, thereby obtained the multilayered color light-sensitive material (sample B). Numerals indicate an addition amount per $m^2$. Note that the effects of the added compounds are not limited to those described in the following.

| | | |
|---|---|---|
| Layer 1: Antihalation Layer | | |
| Black colloidal silver | | 0.25 g |
| Gelatin | | 1.9 g |
| Ultraviolet absorbent U-1 | | 0.04 g |
| Ultraviolet absorbent U-2 | | 0.1 g |
| Ultraviolet absorbent U-3 | | 0.1 g |
| Ultraviolet absorbent U-6 | | 0.1 g |
| High-boiling organic solvent Oil-1 | | 0.1 g |
| Layer 2: Interlayer | | |
| Gelatin | | 0.40 g |
| Compound Cpd-D | | 10 mg |
| High boiling organic solvent Oil-3 | | 40 g |
| Layer 3: Interlayer | | |
| Fogged fine grain silver iodobromide emulsion (average grain size = 0.06 μm, AgI content = 1 mol %) | silver | 0.05 g |
| Gelatin | | 0.4 g |
| Layer 4: Low-Sensitivity Red-Sensitive Emulsion Layer | | |
| Silver iodobromide emulsion spectrally sensitized by sensitizing dyes S-1 and S-2 (a 1:1 mixture of monodisperse cubic grains having an average grain size of 0.4 μm and an AgI content of 4.5 mol % and a monodisperse cubic grains having an average grain size of 0.3 μm and an AgI content of 4.5 mol %) | silver | 0.7 g |
| Gelatin | | 0.8 g |
| Coupler C-1 | | 0.20 g |
| Coupler C-9 | | 0.05 g |
| Compound Cpd-D | | 10 mg |
| High-boiling organic solvent Oil-2 | | 0.1 g |
| Layer 5: Medium-Sensitivity Red-Sensitive Emulsion Layer | | |
| Silver iodobromide emulsion spectrally sensitized by sensitizing dyes S-1 and S-2 (monodisperse cubic grains having an average grain size of 0.5 μm and an AgI content of 4 mol %) | silver | 0.5 g |
| Gelatin | | 0.8 g |
| Coupler C-1 | | 0.2 g |
| Coupler C-2 | | 0.05 g |
| Coupler C-3 | | 0.2 g |
| High-boiling organic solvent Oil-2 | | 0.1 g |
| Layer 6: High-Sensitivity Red-Sensitive Emulsion Layer | | |
| Emulsion 25 | silver | 0.5 g |
| Gelatin | | 1.1 g |
| Coupler C-3 | | 0.7 g |
| Coupler C-1 | | 0.3 g |
| Layer 7: Interlayer | | |
| Gelatin | | 0.6 g |
| Dye D-1 | | 0.02 g |
| Layer 8: Interlayer | | |
| Fogged silver iodobromide emulsion (average grain size = 0.06 μm, AgI content = 0.3 mol %) | silver | 0.02 g |
| Gelatin | | 1.0 g |
| Color-mixing inhibitor Cpd-A | | 0.2 g |
| Layer 9: Low-Sensitivity Green-Sensitive Emulsion Layer | | |
| Silver iodobromide emulsion spectrally sensitized by sensitizing dyes S-3 and S-4 (a 1:1 mixture of monodisperse cubic grains having an average grain size of 0.4 μm and an AgI content of 4.5 mol % and monodisperse cubic grains having an average grain size of 0.2 μm and an AgI content of 4.5 mol %) | silver | 0.5 g |
| Gelatin | | 0.5 g |
| Coupler C-4 | | 0.10 g |
| Coupler C-7 | | 0.10 g |
| Coupler C-8 | | 0.10 g |
| Compound Cpd-B | | 0.03 g |
| Compound Cpd-E | | 0.02 g |
| Compound Cpd-F | | 0.02 g |
| Compound Cpd-G | | 0.02 g |
| Compound Cpd-H | | 0.02 g |
| Compound Cpd-D | | 10 mg |
| High-boiling organic solvent Oil-1 | | 0.1 g |
| High-boiling organic solvent Oil-2 | | 0.1 g |
| Layer 10: Medium-Sensitivity Green-Sensitive Emulsion Layer | | |
| Silver iodobromide emulsion spectrally sensitized by sensitizing dyes S-3 and S-4 (monodisperse cubic grains having an average grain size of 0.5 μm and an AgI content of 3 mol %) | silver | 0.4 g |
| Gelatin | | 0.6 g |
| Coupler C-4 | | 0.1 g |
| Coupler C-7 | | 0.1 g |
| Coupler C-8 | | 0.1 g |
| Compound Cpd-B | | 0.03 g |
| Compound Cpd-E | | 0.02 g |
| Compound Cpd-F | | 0.02 g |
| Compound Cpd-G | | 0.05 g |
| Compound Cpd-H | | 0.01 g |
| High-boiling organic solvent Oil-2 | | 0.01 g |
| Layer 11: High-Sensitivity Green-Sensitive Emulsion Layer | | |
| Silver iodobromide emulsion spectrally sensitized by sensitizing dyes S-3 and S-4 (monodisperse tabular grains having an average sphere-equivalent grain size of 0.6 μm, an AgI content of 1.3 mol %, and an average diameter/thickness ratio of 7) | silver | 0.8 g |
| Gelatin | | 1.0 g |
| Coupler C-4 | | 0.4 g |
| Coupler C-7 | | 0.2 g |
| Coupler C-8 | | 0.2 g |
| Compound Cpd-B | | 0.08 g |
| Compound Cpd-E | | 0.02 g |
| Compound Cpd-F | | 0.02 g |
| Compound Cpd-G | | 0.02 g |
| Compound Cpd-H | | 0.02 g |
| High-boiling organic solvent Oil-1 | | 0.02 g |
| High-boiling organic solvent Oil-2 | | 0.02 g |
| Layer 12: Interlayer | | |
| Gelatin | | 0.6 g |
| Dye D-2 | | 0.05 g |
| Layer 13: Yellow Filter Layer | | |
| Yellow colloidal silver | silver | 0.1 g |
| Gelatin | | 1.1 g |
| Color-mixing inhibitor Cpd-A | | 0.01 g |
| High-boiling organic solvent Oil-1 | | 0.01 g |
| Layer 14: Interlayer | | |
| Gelatin | | 0.6 g |
| Layer 15: Low-Sensitive Blue-Sensitive Emulsion Layer | | |
| Silver iodobromide emulsion sensitized by sensitizing dyes S-5 and S-6 (a 1:1 mixture of monodisperse cubic grains having an average grain size of 0.4 μm and an AgI content of 3 mol % and monodisperse cubic grains having and average grain size of 0.2 μm and an AgI content of 3 mol %) | silver | 0.6 g |
| Gelatin | | 0.8 g |
| Coupler C-5 | | 0.6 g |
| High-boiling organic solvent Oil-2 | | 0.02 g |
| Layer 16: Medium-Sensitivity Blue-Sensitive Emulsion Layer | | |
| Silver iodobromide emulsion sensitized by sensitizing dyes S-5 and S-6 (monodisperse cubic grains having an average grain size of 0.5 μm and an AgI content of 2 mol %) | silver | 0.3 g |
| Gelatin | | 0.9 g |
| Coupler C-5 | | 0.3 g |
| Coupler C-6 | | 0.3 g |
| High-boiling organic solvent Oil-2 | | 0.02 g |
| Layer 17: High-Sensitivity Blue-Sensitive Emulsion Layer | | |
| Silver iodobromide emulsion sensitized by sensitizing dyes S-5 and S-6 (tabular grains having an average sphere-equivalent grain size of 0.7 μm, AgI content of 1.5 mol %, and an average diameter/thickness ratio of 7) | silver | 0.5 g |
| Gelatin | | 1.2 g |
| Coupler C-6 | | 0.7 |
| Layer 18: 1st Protective Layer | | |
| Gelatin | | 0.7 g |
| Ultraviolet absorbent U-1 | | 0.04 g |
| Ultraviolet absorbent U-3 | | 0.03 g |

-continued

| | | |
|---|---|---|
| Ultraviolet absorbent U-4 | | 0.03 g |
| Ultraviolet absorbent U-5 | | 0.05 g |
| Ultraviolet absorbent U-6 | | 0.05 g |
| High-boiling organic solvent Oil-1 | | 0.02 g |
| Formalin scaverger Cpd-C | | 0.8 g |
| Dye D-3 | | 0.05 g |
| Layer 19: 2nd Protective Layer | | |
| Fogged fine grain silver iodobromide emulsion (average grain size = 0.06 μm, AgI content = 1 mol %) | silver | 0.1 g |
| Gelatin | | 0.4 g |
| Layer 20: 3rd Protective Layer | | |
| Gelatin | | 0.4 g |
| Polymethylmethacrylate (average grain size = 1.5 μm) | | 0.1 g |
| 4:6 copolymer of methylmethacrylate and acrylic acid (average grain size = 1.5 μm) | | 0.1 g |
| Silicone oil | | 0.03 g |
| Surfactant W-1 | | 3.0 mg |

In addition to the above compositions, a gelatin hardener H-1 and surfactants for coating and emulsification were added to the individual layers.

Note that in the emulsions used, "monodisperse" means that a variation coefficient is 20% or less. Formulas of the compounds used in the preparation of the sample B are listed in Table C to be presented later.

| | | Processing Method | | |
|---|---|---|---|---|
| Process | Time | Temperature | Tank Volume | Replenishing Amount |
| Black/White Development | 6 min. | 38° C. | 12 l | 2.2 l/m² |
| 1st Washing | 2 min. | 38° C. | 4 l | 7.5 l/m² |
| Reversal | 2 min. | 38° C. | 4 l | 1.1 l/m² |
| Color Development | 6 min. | 38° C. | 12 l | 2.2 l/m² |
| Control | 2 min. | 38° C. | 4 l | 1.1 l/m² |
| Bleaching | 6 min. | 38° C. | 12 l | 0.22 l/m² |
| Fixing | 4 min. | 38° C. | 8 l | 1.1 l/m² |
| 2nd Washing | 4 min. | 38° C. | 8 l | 7.5 l/m² |
| Stabilizing | 1 min. | 25° C. | 2 l | 1.1 l/m² |

The compositions of the respective processing solutions were as follows.

| | Mother Solution | Replenishment Solution |
|---|---|---|
| Black/White Developing Solution: | | |
| Pentasodium nitrilo-N,N,N-trimethylene phosphonate | 2.0 g | 2.0 g |
| Sodium sulfite | 30 g | 30 g |
| Potassium hydroquinone monosulfonate | 20 g | 20 g |
| Potassium carbonate | 33 g | 33 g |
| 1-phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |
| The pH was adjusted by hydrochloric acid or potassium hydroxide. | | |
| Reversal Solution: | | |
| Pentasodium nitrilo-N,N,N-trimethylene phosphonate | 3.0 g | the same as mother solution |
| Stannous chloride dihydrate | 1.0 g | |

-continued

| | Mother Solution | Replenishment Solution |
|---|---|---|
| p-aminophenol | 0.1 g | |
| Sodium hydroxide | 8 g | |
| Glacial acetic acid | 15 ml | |
| Water to make | 1,000 ml | |
| pH | 6.00 | |
| The pH was adjusted by hydrochloric acid or sodium hydroxide. | | |
| Color Developing Solution: | | |
| Pentasodium nitrilo-N,N,N-trimethylene phosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N(β-methanesulfonamidoethyl)-3-methyl-4-aminoaniline sulfate | 11 g | 11 g |
| 3.6-dithia-1,8-octane diol | 1.0 g | 1.0 g |
| Water to make | 1,000 ml | 1,000 ml |
| pH | 11.80 | 12.00 |
| The pH was adjusted by hydrochloric acid or potassium hydroxide. | | |
| Control Solution: | | |
| Disodium ethylenediaminetetraacetate dihydrate | 8.0 g | the same as mother solution |
| 1-thioglycerin | 0.4 ml | |
| Sorbitan ester* | 0.1 g | |
| Water to make | 1,000 ml | |
| pH | 6.20 | |
| The pH was adjusted by hydrochloric acid or sodium hydroxide. | | |
| Bleaching Solution: | | |
| Disodium ethylenediaminetetraacetate dihydrate | 2.0 g | 4.0 g |
| Ammonium Fe(III) ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| The pH was adjusted by hydrochloric acid or sodium hydroxide. | | |
| Fixing Solution: | | |
| Ammonium thiosulfate | 8.0 g | the same as mother solution |
| Sodium sulfite | 5.0 g | |
| Sodium bisulfite | 5.0 g | |
| Water to make | 1,000 ml | |
| pH | 6.60 | |
| The pH was adjusted by hydrochloric acid or ammonia water. | | |
| Stabilizing Solution: | | |
| Formaline (37%) | 5.0 ml | the same as mother solution |
| Polyoxyethylene-p-monononylphenylether (average polymerization degree = 10) | 0.5 ml | |
| Water to make | 1,000 ml | |
| pH | not adjusted | |

*The chemical structure is shown in Table G to be presented later.

TABLE A
Formula (I)
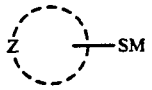
Formula (II)
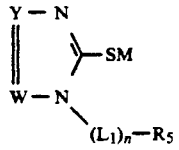
Formula (II)
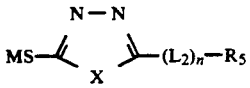
TABLE B
(1)
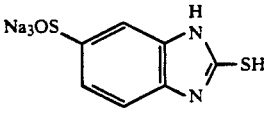
(2)
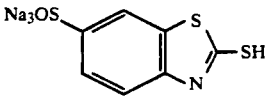
(3)
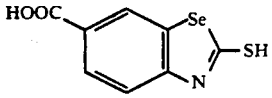
(4)
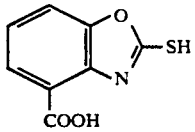
(5)
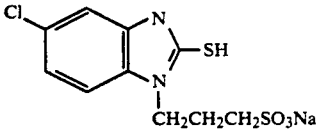
(6)
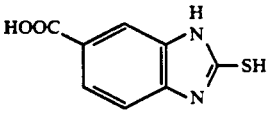
(7)
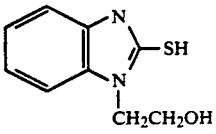
(8)
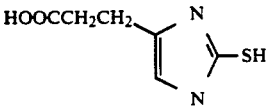
TABLE B-continued
(9)
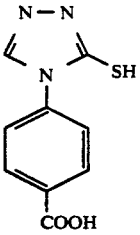
(10)
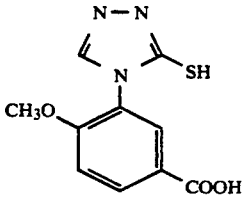
(11)
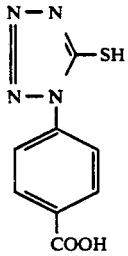
(12)
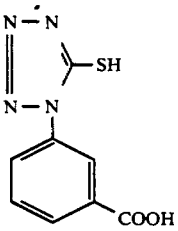
(13)
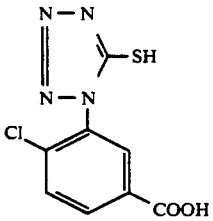
(14)
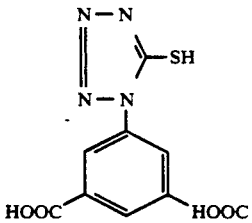
(15)
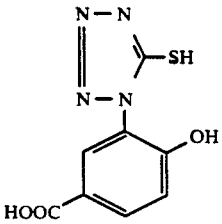

TABLE B-continued
(16)
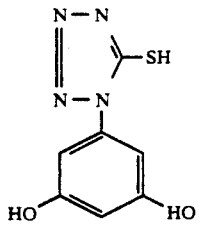
(17)
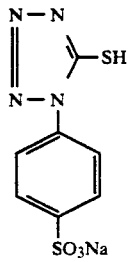
(18)
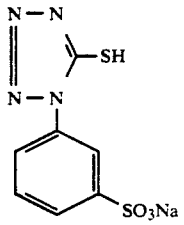
(19)
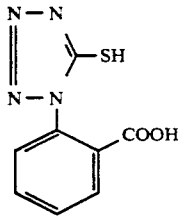
(20)
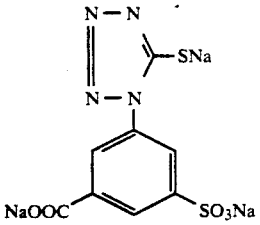
(21)
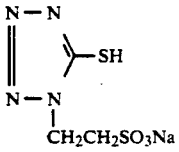
(22)
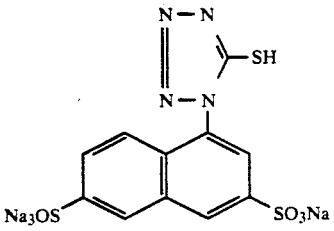
TABLE B-continued
(23)
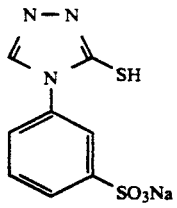
(24)
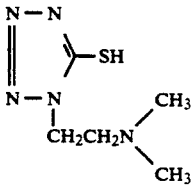
(25)
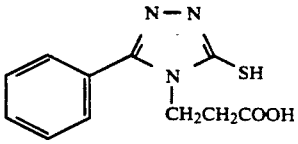
(26)
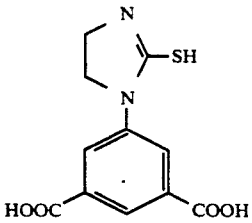
(27)
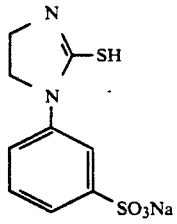
(28)
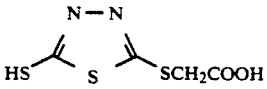
(29)
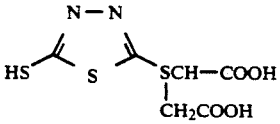
(30)
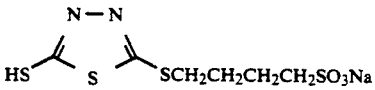
(31)
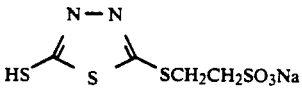
(32)
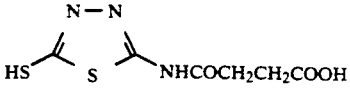

TABLE B-continued
(33)
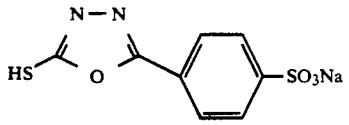
(34)
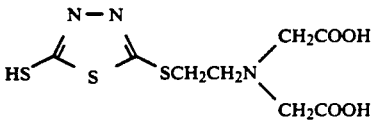
(35)
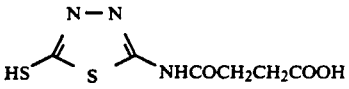
(36)
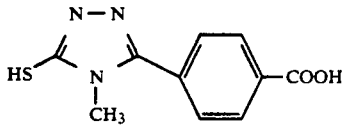
(37)
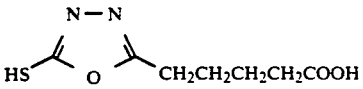
(38)
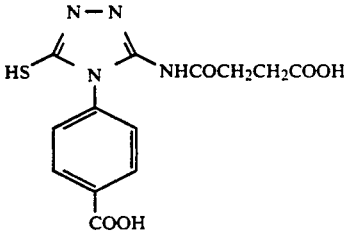
(39)
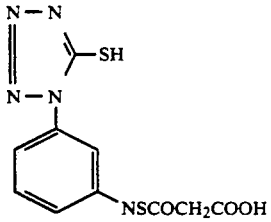
(40)
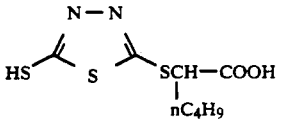
(41)
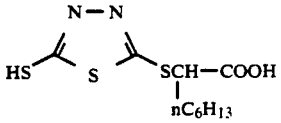
(42)
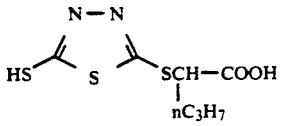
TABLE B-continued
(43)
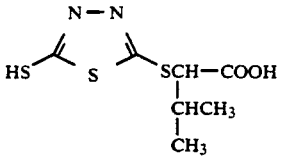
TABLE C
Compound (C-1)
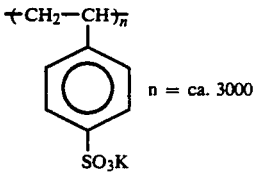
Compound (C-2)
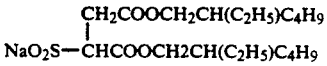
Compound (C-3)
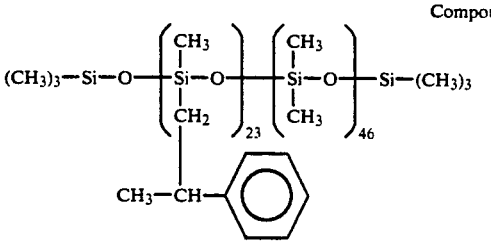
Compound (C-4)
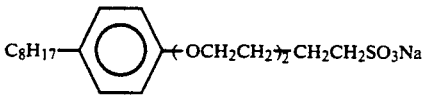
TABLE D
Coupler (D-1)
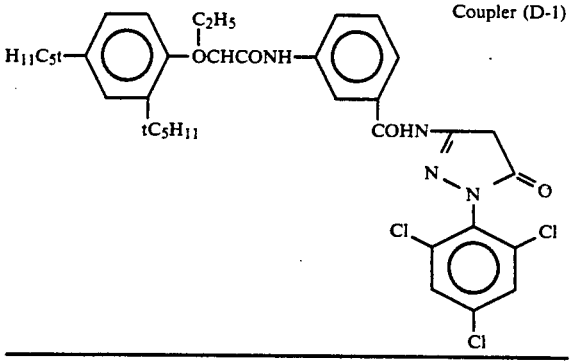

TABLE E
Coupler (E-1)
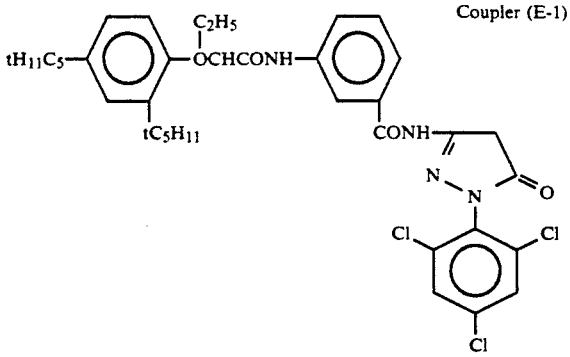
TABLE E-continued
Bleaching accelater (E-2)
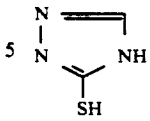
TABLE F
EX-1
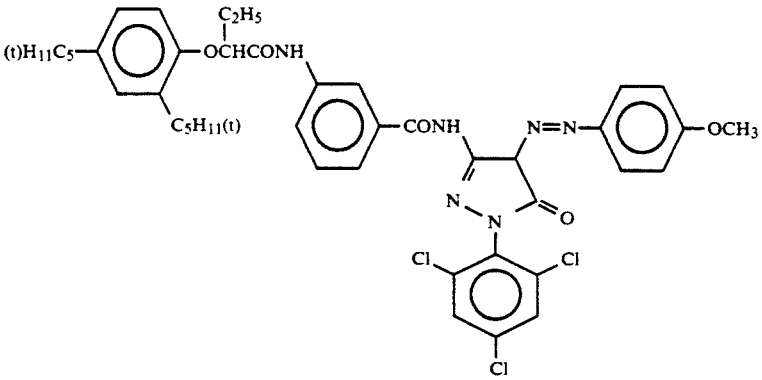
EX-2
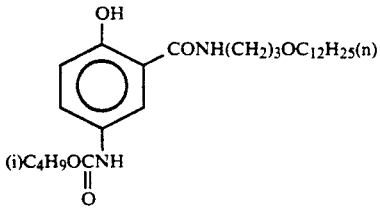
Ex-3
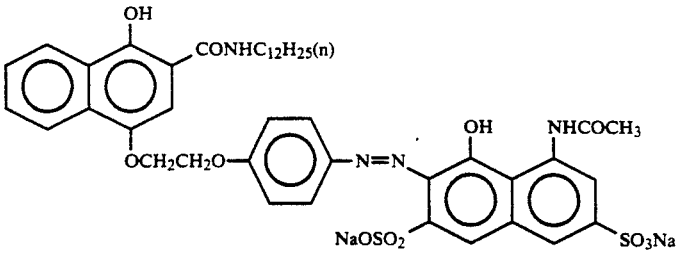
EX-4
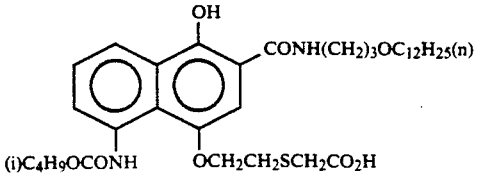

TABLE F-continued
EX-5
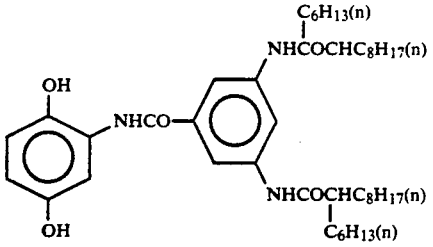
EX-6
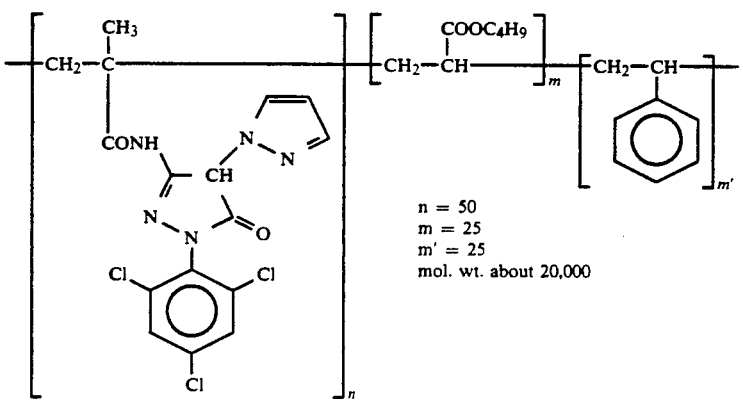
EX-7
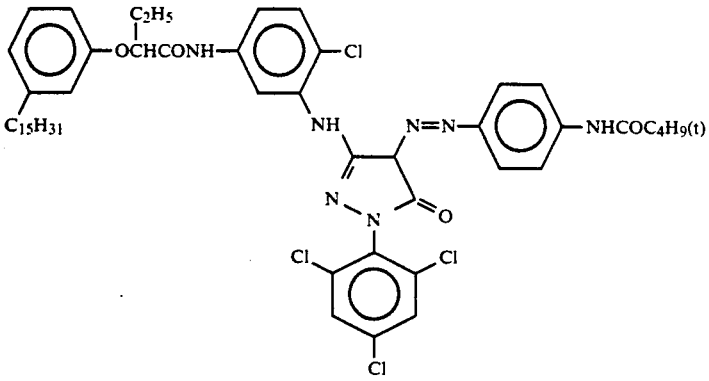
EX-8
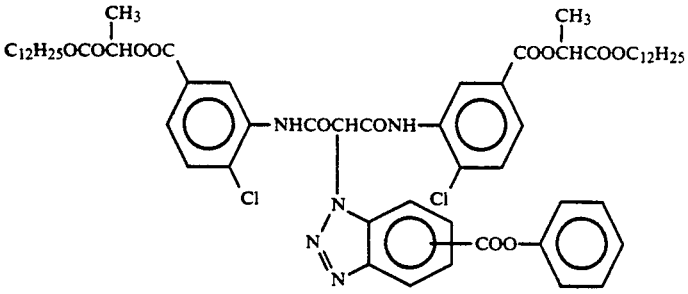
EX-9
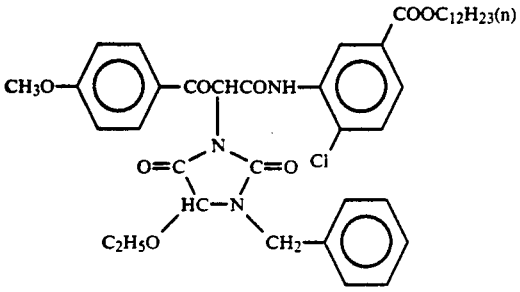

TABLE F-continued
EX-10
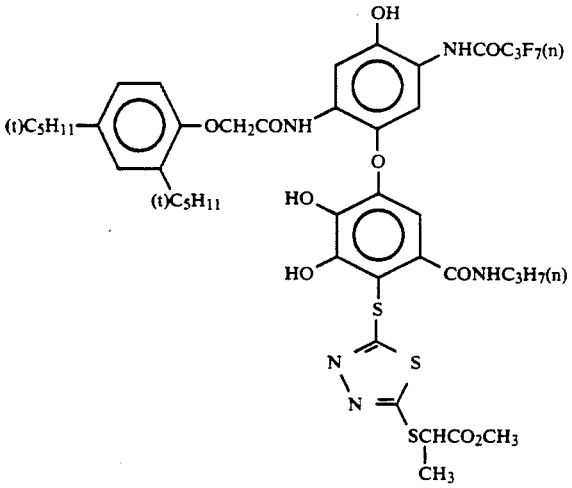
EX-11
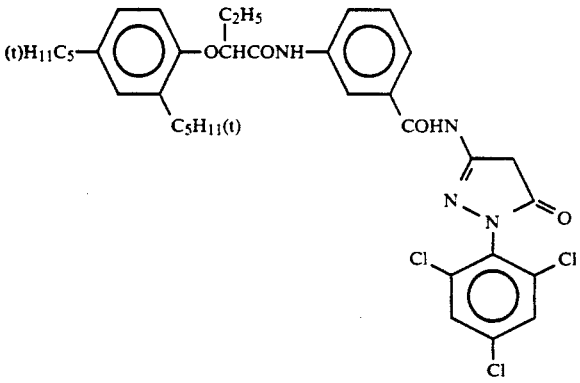
EX-12
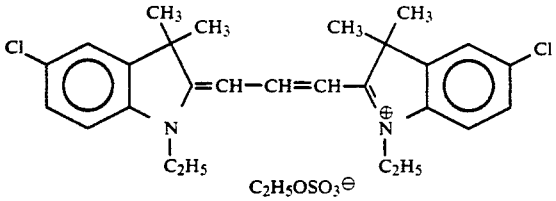
EX-13
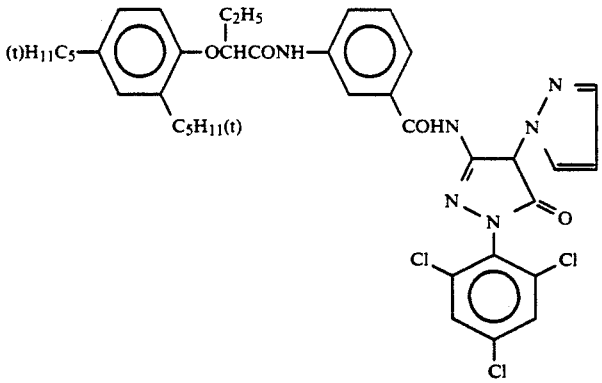
U-1
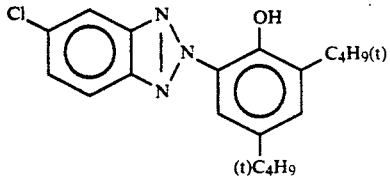

TABLE F-continued
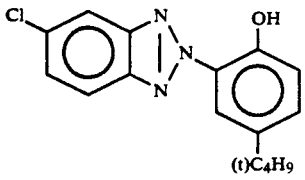
U-2
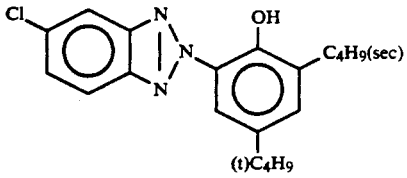
U-3
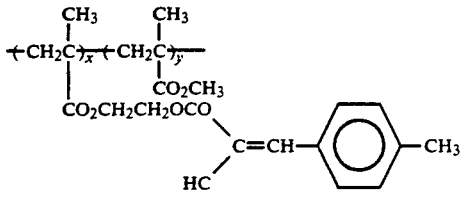
X:Y = 70:30 (wt %)
U-4
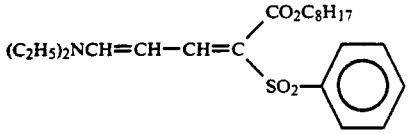
UV-5
tricresyphosphate HBS-1
di-n-butylphtalate HBS-2
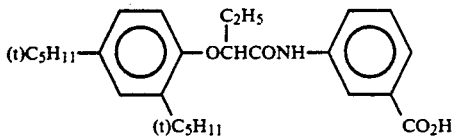
HBS-3
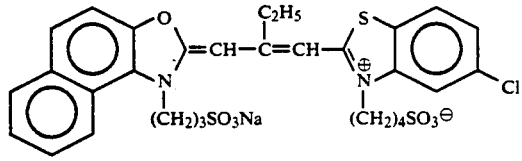
Sensitizing dye I
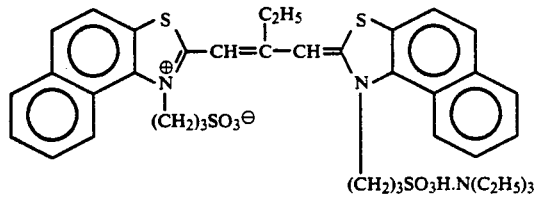
Sensitizing dye II
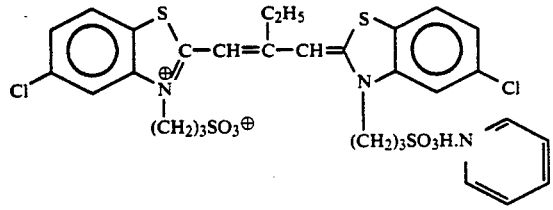
Sensitizing dye III TABLE F-continued
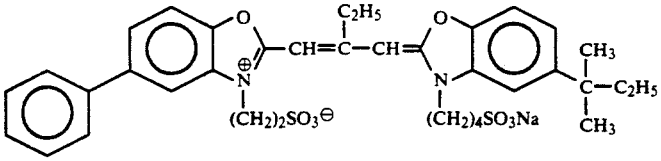
Sensitizing dye IV
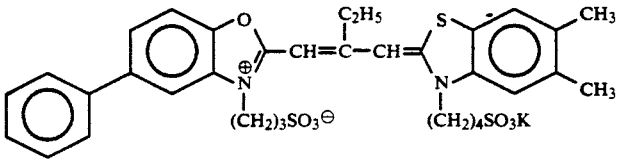
Sensitizing dye V
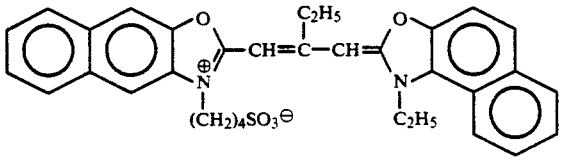
Sensitizing dye VI
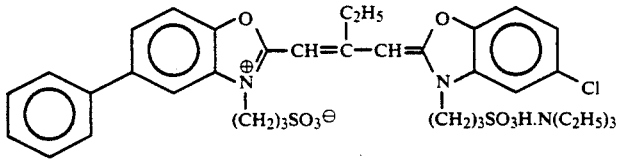
Sensitizing dye VII
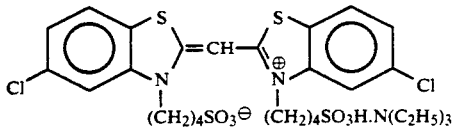
Sensitizing dye VIII
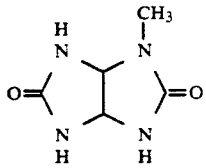
S-1
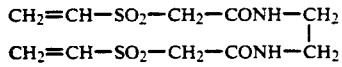
H-1
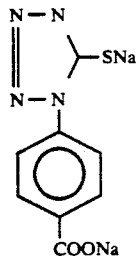
EX-14
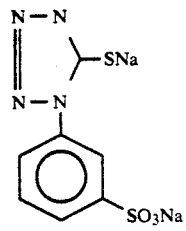
EX-15

TABLE F-continued
| | |
|---|---|
| Copolymer of polyvinylpyrrolidone and polyvinylalcohol | EX-16 |
| 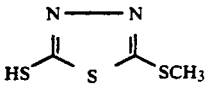 | EX-17 |
| 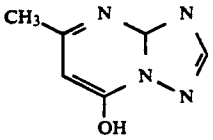 | EX-18 |
| 1,2-benzisothiazoline-3-one | EX-19 |
| n-butyhl-p-hydroxybenzoate | EX-20 |
| 2-phenoxyethanol | EX-21 |
| 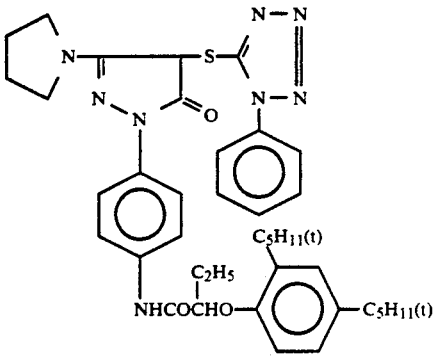 | EX-22 |
TABLE G
C-1
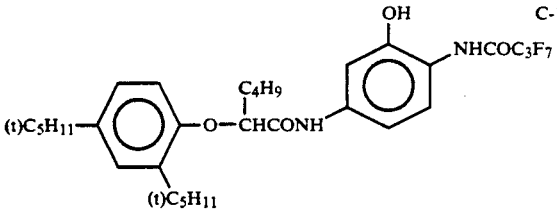
C-2
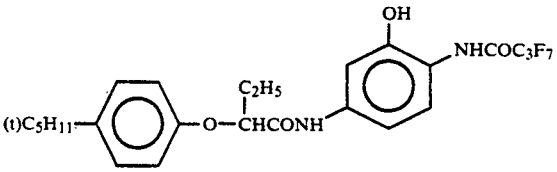
C-3
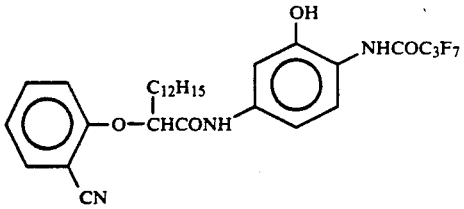
C-4
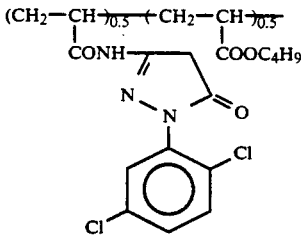
C-5
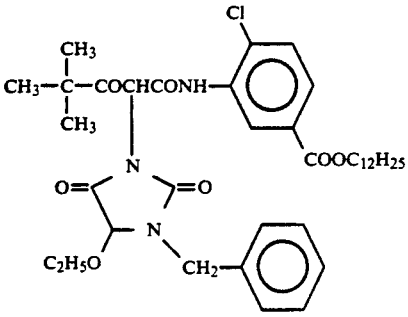
C-6
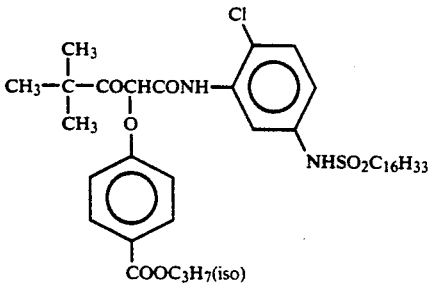

TABLE G-continued
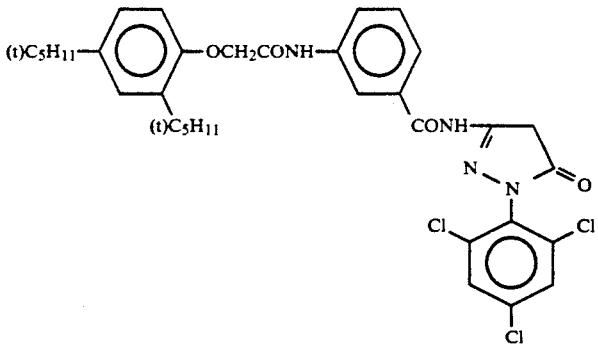
C-7
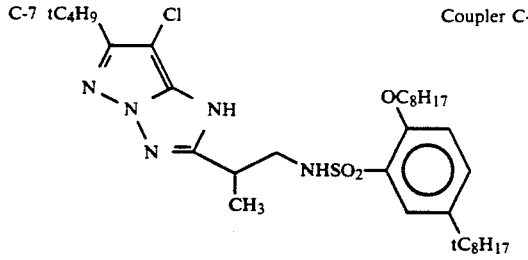
Coupler C-8
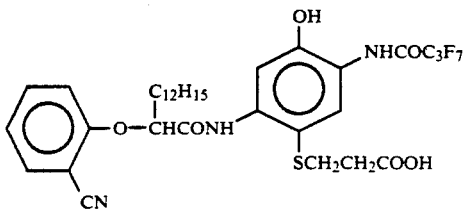
C-9
bibutylphtalate
Oil-1
tricresylphosphate
Oil-2
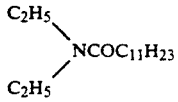
Oil-3
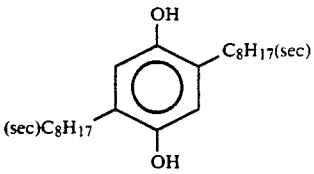
Cpd-A
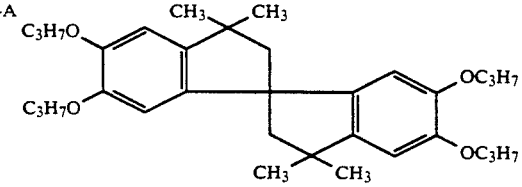
Cpd-B
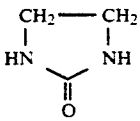
Cpd-C
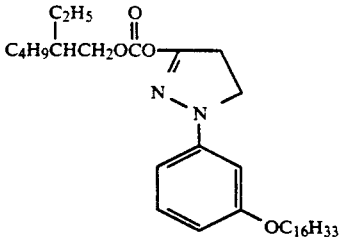
Cpd-E
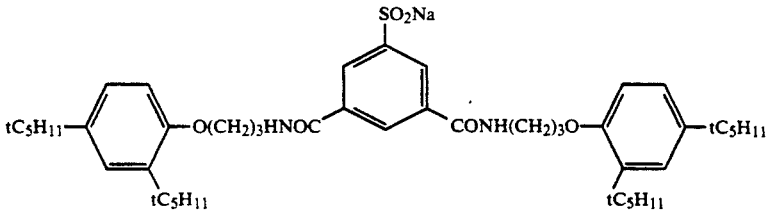
Cpd-F
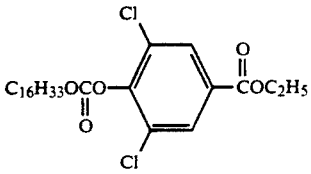
Cpd-G
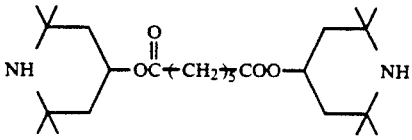
Cpd-H TABLE G-continued
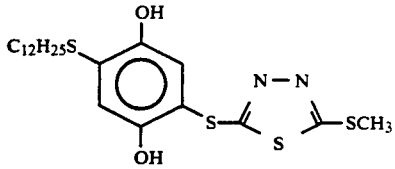
Cpd-D
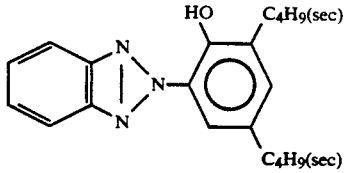
U-1
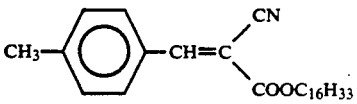
U-2
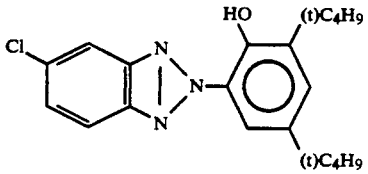
U-3
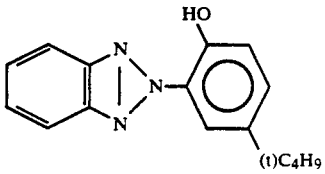
U-4
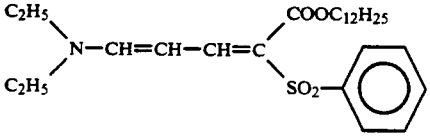
U-5
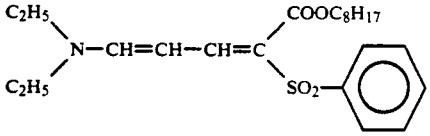
U-6
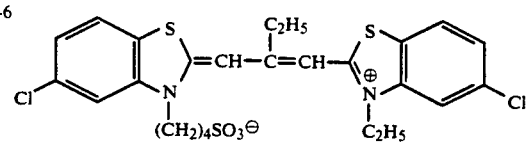
S-1
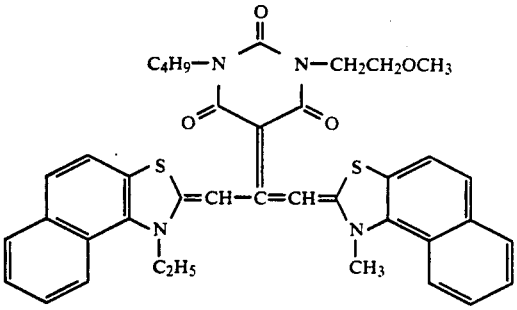
S-2
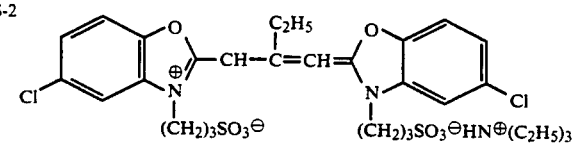
S-3
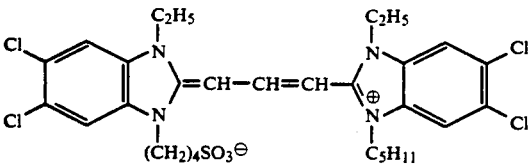
S-4
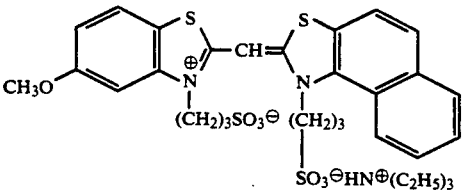
S-5
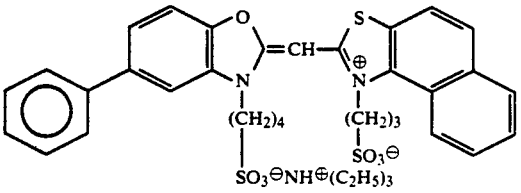
S-6
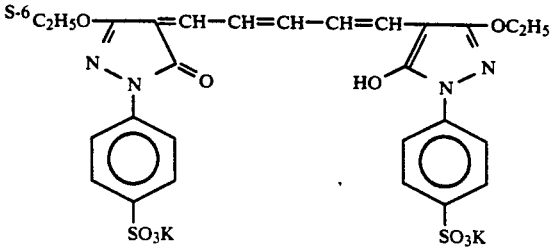
D-1

TABLE G-continued

D-2

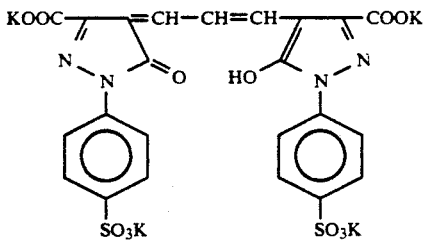

D-3

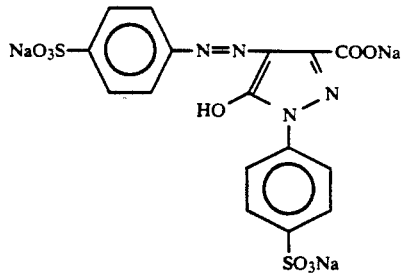

H-1

$CH_2{=}CHSO_2CH_2CONHCH_2$
$CH_2{=}CHSO_2CH_2CONHCH_2$

W-1

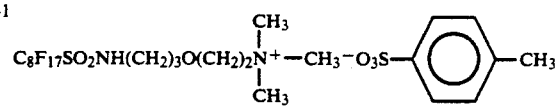

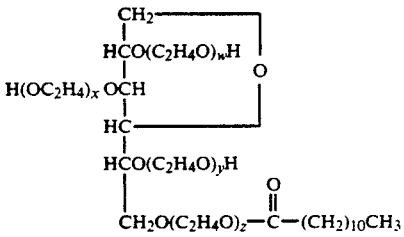

(w + x + y + z = 20)

What is claimed is:

1. A silver halide photographic light-sensitive material having at least one silver halide emulsion layer on a support, wherein light-sensitive silver halide grains contained in said silver halide emulsion layer have been subjected to selenium sensitization, and said silver halide emulsion layer or another hydrophilic colloid layer which is in a water-permeable relationship with said silver halide emulsion layer contains at least one compound represented by formula (II) and at least one compound represented by formula (III):

Formula (II)

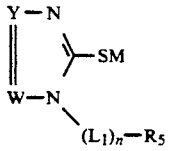

wherein Y and W independently represent nitrogen or $CR_4$ (wherein $R_4$ represents hydrogen, substituted or unsubstituted aklyl, or substituted or unsubstituted aryl), $R_5$ represents an organic moiety having at least one substituting group selected from the group consisting of $—SO_3M$, —COOM, —OH, and $—NR_2$, M represents hydrogen, alkali metal, quaternary ammonium, or quaternary phosphonium, $R_2$ represents hydrogen, alkyl having 1 to 6 carbon atoms, $—COR_3$, $—COOR_3$, or $—SO_2R_3$, $L_1$ represents a bonding group selected from the group consisting of —S—, —O—, —N(—)—, —CO—, —SO—, and $—SO_2—$, and n represents 0 or 1;

Formula (III)

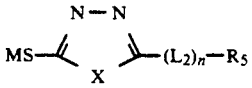

wherein X represents sulfur, oxygen, or $—NR_6—$, $R_6$ represents hydrogen, substituted or unsubstituted alkyl, or substituted or unsubstituted aryl, $L_2$ represents $—CONR_7$, $—NR_7CO—$, $—SO_2NR_7—$, $—NR_7SO_2—$, —OCO—, —COO—, —S—, $—NR_7—$, —CO—, —SO—, —OCOO—, $—NR_7CONR_8—$, $—NR_7COO—$, $—OCONR_7—$, or $—NR_7SO_2NR_8—$, $R_7$ and $R_8$ each represents hydrogen, substituted or unsubstituted alkyl group, or substituted or unsubstituted aryl, and $R_5$ represents an organic moiety having at least one substituent group selected from the group consisting of $—SO_3M$, —COOM, —OH, and $—NHR_2$, M represents hydrogen, alkali metal, quaternary ammonium or quaternary phosphonium and n represents 0 or 1.

2. The silver halide photographic light-sensitive material according to claim 1, wherein a labile selenium compound is present during the selenium sensitization.

3. The silver halide photographic light-sensitive material according to claim 1, wherein an amount of selenium sensitizer added during selenium sensitization is $10^{-8}$ to $10^{-4}$ mol per mol of silver halide.

4. The silver halide photographic light-sensitive material according to claim 1, wherein a noble metal sensitizer is used together with the selenium sensitizer.

5. The silver halide photographic light-sensitive material according to claim 4, wherein the noble metal sensitizer is present in an amount of about $10^{-7}$ to $10^{-2}$ mol per mol of silver halide.

6. The silver halide photographic light-sensitive material according to claim 1, wherein a sulfur sensitizer is used together with a selenium sensitizer.

7. The silver halide photographic light-sensitive material according to claim 6, wherein the sulfur sensitizer is present in an amount of $10^{-7}$ to $10^{-2}$ mol per mol of silver halide.

8. The silver halide photographic light-sensitive material according to claim 1, wherein a reduction sensitizer is used together with a selenium sensitizer.

9. The silver halide photographic light-sensitive material according to claim 1, wherein in Formula (II), $R_4$ or $R_5$ is an alkyl group having 1 to 20 carbon atoms.

10. The silver halide photographic light-sensitive material according to claim 1, wherein in Formula (II), $R_4$ is an aryl group having 6 to 20 carbon atoms.

11. The silver halide photographic light-sensitive material according to claim 1, wherein X is sulfur.

12. The silver halide photographic light-sensitive material according to claim 1, wherein $R_5$ is $—SO_3M$ or —COOM.

13. The silver halide photographic light-sensitive material according to claim 1, wherein the amount of a compound of Formula (II) or Formula (III) is $1\times10^{-5}$ to $1\times10^{-1}$ g/m$^2$.

14. The silver halide photographic light-sensitive material according to claim 1, wherein the compound represented by Formula (II) or Formula (III) is present in an amount of $1\times10^{-6}$ to $1\times10^{-1}$ mol per mol of silver halide subjected to selenium sensitization.

15. The silver halide photographic light-sensitive material according to claim 1, wherein the silver halide emulsion which is subjected to selenium sensitization contains silver bromide grains, silver iodobromide grains, silver iodochlorobromide grains, silver chlorobromide grains or silver chloride grains.

16. A method for processing a silver halide color photographic light-sensitive material which comprises imagewise exposing and color developing the silver halide photographic light-sensitive material according to claim 1 at a temperature of 40° C. or more.

17. A method for processing a silver halide color photographic light-sensitive material which comprises imagewise exposing and color developing the silver halide photographic light-sensitive material according to claim 1, wherein the volume of a developer replenisher is 1,000 ml or less per 1 m$^2$ of the light-sensitive material.

* * * * *